US007708265B2

(12) United States Patent
Kusama

(10) Patent No.: US 7,708,265 B2
(45) Date of Patent: May 4, 2010

(54) SHEET FEEDER

(75) Inventor: Takuro Kusama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 199 days.

(21) Appl. No.: 11/842,550

(22) Filed: Aug. 21, 2007

(65) Prior Publication Data

US 2008/0048384 A1 Feb. 28, 2008

(30) Foreign Application Priority Data

Aug. 25, 2006 (JP) ..... 2006-228623

(51) Int. Cl.
*B65H 3/06* (2006.01)

(52) U.S. Cl. ..... 271/117; 271/164; 271/127; 271/171

(58) Field of Classification Search ..... 271/117, 271/162, 127, 147, 157, 160, 164, 171
See application file for complete search history.

(56) References Cited

U.S. PATENT DOCUMENTS

| | | | | |
|---|---|---|---|---|
| 4,726,698 | A * | 2/1988 | Weiss et al. | 400/629 |
| 5,564,690 | A * | 10/1996 | Oshida | 271/157 |
| 6,039,315 | A * | 3/2000 | Lim | 271/160 |
| 7,410,162 | B2 * | 8/2008 | Takasaka et al. | 271/160 |
| 7,448,613 | B2 * | 11/2008 | Takahashi | 271/157 |
| 2004/0251600 | A1 * | 12/2004 | Amamoto | 271/152 |
| 2006/0180986 | A1 | 8/2006 | Hattori | |

FOREIGN PATENT DOCUMENTS

| | | |
|---|---|---|
| JP | 7267392 | 10/1995 |
| JP | 9110195 | 4/1997 |
| JP | 2003212363 | 7/2003 |
| JP | 2005292236 | 10/2005 |
| JP | 2006176321 | 7/2006 |

* cited by examiner

*Primary Examiner*—Patrick Mackey
*Assistant Examiner*—Jeremy Severson
(74) *Attorney, Agent, or Firm*—Banner & Witcoff, Ltd.

(57) ABSTRACT

A sheet feeder includes a housing having a cassette housing part recessed horizontally from the front surface toward the depth direction and a sheet feed cassette that can be drawn from the cassette housing part. The sheet feed cassette has an open top for storing sheets of paper. The sheet feeder includes a pressure plate provided pivotably about a first pivot so as to be inclined downwardly toward the depth direction of the sheet feed cassette and a pressure mechanism that presses sheets of paper against a pick-up roller when the sheet feed cassette is pushed into the cassette housing part. The sheet feeder includes a pressure plate regulation mechanism that inclines the pressure plate downwardly toward the depth direction while separating sheets of paper on the pressure plate or the pressure plate from the pick-up roller when the sheet feed cassette is drawn from the cassette housing part.

17 Claims, 17 Drawing Sheets

SHEET FEEDER

CROSS-REFERENCE TO RELATED APPLICATION

This application claims the benefit of Japanese Patent Application No. 2006-228623 filed on Aug. 25, 2006, which is incorporated herein by reference.

BACKGROUND OF THE INVENTION

The present invention relates to a sheet feeder.

Conventional sheet feeders are disclosed in JP-A-2005-292236 and JP-A-2006-176321. The sheet feeder has a housing, a sheet feed cassette, a pressure plate, and a pressure mechanism.

The housing has a cassette housing part. The cassette housing part is recessed horizontally from the front surface toward the depth direction. Further, a pick-up roller that is driven rotationally about a horizontal axis perpendicular to the depth direction is provided in the upper part at the front surface side within an opening of the cassette housing part.

The sheet feed cassette has a holding chamber having an open top for storing stacked sheets of paper, and can be housed within the cassette housing part and drawn from the cassette housing part.

The pressure plate is provided pivotably about a pivot in parallel with the horizontal axis so as to be inclined downwardly toward the depth direction of the sheet feed cassette.

The pressure mechanism presses sheets of paper against the pick-up roller by increasing the angle of inclination of the pressure plate when the sheet feed cassette is pushed into the cassette housing part.

The conventional sheet feeder having such a configuration is applied to an image forming apparatus such as an electrophotographic printer. As described below, the sheets of paper are loaded in the sheet feed cassette and the sheets of paper are fed to the image forming apparatus.

First, a user draws the sheet feed cassette from the cassette housing part of the housing to draw the sheet feed cassette by the length more than the length of sheets in the depth direction. Concurrently, the pressure plate is horizontal at the reduced angle of inclination.

Next, the user stacks sheets of paper from above the holding chamber of the sheet feed cassette, and then, inserts the sheet feed cassette from the front of the housing to the depth direction to make the sheet feed cassette housed in the cassette housing part.

In this manner, when the sheet feed cassette is pushed into the cassette housing part, the pressure mechanism increases the angle of inclination of the pressure plate and presses the sheets of paper against the pick-up roller. Thereby, the loading of sheets of paper in the sheet feeder is completed. Further, in the sheet feeder, when the sheets of paper are fed to the image forming apparatus, the pick-up roller rotates and associated components such as rollers and guides provided around work in conjunction with the pick-up roller. Thus, the sheets of paper can be fed one by one to the image forming apparatus from the upper part of the front surface side within the opening.

By the way, image forming apparatuses such as printers have been recently downsized and often placed near the work areas on the desks or the like. Accordingly, it is desired for the image forming apparatus to occupy the smaller space so as not to reduce the work area. On this account, it is also desired for the above described conventional sheet feeder to occupy the smaller space.

However, in the above described conventional sheet feeder, it has been difficult to make the occupied space smaller at the front surface side of the sheet feeder because the sheet feed cassette must be drawn by the length more than the length of sheets in the depth direction when the sheets of paper are loaded in the sheet feed cassette.

BRIEF SUMMARY OF THE INVENTION

The invention has been achieved in view of the above described conventional circumstances, and a purpose of the invention is to provide a sheet feeder that can occupy the smaller space.

The sheet feeder of the invention includes a housing, a sheet feed cassette, a pressure plate, a pressure mechanism, and a pressure plate regulation mechanism. The housing has a cassette housing part. The cassette housing part is recessed horizontally from the front surface toward the depth direction, and provided with a pick-up roller that is driven rotationally about a horizontal axis perpendicular to the depth direction in the upper part at the front surface side within an opening thereof. The sheet feed cassette has a holding chamber having an open top for storing stacked sheets. The sheet feed cassette is can be housed within the cassette housing part and drawn from the cassette housing part. The pressure plate is provided pivotably about a pivot in parallel with the horizontal axis so as to be inclined downwardly toward the depth direction of the sheet feed cassette. The pressure mechanism presses sheets against the pick-up roller by increasing the angle of inclination of the pressure plate when the sheet feed cassette is pushed into the cassette housing part. The pressure plate regulation mechanism inclines the pressure plate downwardly toward the depth direction while separating the sheets on the pressure plate or the pressure plate from the pick-up roller when the sheet feed cassette is drawn from the cassette housing part by a length less than a length of sheets in the depth direction.

In the sheet feeder of the invention, when a user tries to load sheets in the holding chamber of the sheet feed cassette, the user draws the sheet feed cassette from the cassette housing part of the housing by the length less than the length of the sheets of paper in the depth direction (in the "half-open" state in which the depth side of the holding chamber is located within the cassette housing part and the front side of the holding chamber is located outside of the cassette housing part). Then, the pressure plate regulation mechanism separates the sheets on the pressure plate or the pressure plate from the pick-up roller. Accordingly, no sheet remains between the upper most sheet remaining in the holding chamber of the sheet feed cassette and the pick-up roller or in the holding chamber, and a clearance is produced between the pressure plate and the pick-up roller. Further, the pressure plate regulation mechanism inclines the pressure plate downwardly toward the depth direction so that the sheets to be loaded can be guided by the remaining uppermost sheet or the pressure plate.

On this account, the user inserts the sheets from above the front side of the holding chamber toward the depth direction into the sheet feed cassette in this condition, the sheets are guided by the remaining uppermost sheet or the pressure plate and easily stacked in the holding chamber without rubbing against the pick-up roller. Thus, in the sheet feeder, if the sheet feed cassette is not completely drawn from the cassette housing part of the housing, the sheets can be loaded along the pressure plate downwardly inclined toward the depth direction in the holding chamber of the sheet feed cassette.

Therefore, the sheet feeder of the invention can occupy the smaller space so as not to reduce the work area on the desk or the like.

BRIEF DESCRIPTION OF THE SEVERAL VIEWS OF THE DRAWINGS

Hereinafter, embodiments 1 to 3 that embody the invention will be described with reference to the drawings.

FIG. 1 is a sectional view of a sheet feeder of embodiment 1 (in the condition in which the sheet feed cassette is housed in the cassette housing part).

FIG. 2 is a sectional view of the sheet feeder of embodiment 1 (in the condition in which the sheet feed cassette is detached from the cassette housing part).

FIG. 4 is a sectional view of the sheet feed cassette (in the condition in which the pressure plate is horizontal) according to the sheet feeder of embodiment 1.

FIG. 5 is a top view of the sheet feed cassette (in the condition in which the pressure plate is horizontal) according to the sheet feeder of embodiment 1.

FIG. 6 is a sectional view of the sheet feed cassette (in the condition in which the pressure plate is inclined) according to the sheet feeder of embodiment 1.

FIG. 7 is a sectional view of the sheet feeder of embodiment 1 (in the condition in which sheets of paper within the holding chamber can be fed to the image forming unit).

FIG. 8 is a sectional view of the sheet feeder of embodiment 1 (in the condition in which there is no sheets of paper within the holding chamber).

FIG. 9 is a sectional view of the sheet feeder of embodiment 1 (in the condition in which the sheet feed cassette is slightly drawn from the cassette housing part).

FIG. 10 is a schematic diagram showing the positional relationship between guide rails and guide rollers according to the sheet feeder of embodiment 1.

FIG. 11 is a sectional view of the sheet feeder of embodiment 1 (in the condition in which the sheet feed cassette is nearly halfway drawn from the cassette housing part).

FIG. 12 is a sectional view of the sheet feed cassette (in the condition in which the pressure plate is horizontal) according to a sheet feeder of embodiment 2.

FIG. 13 is a top view of the sheet feed cassette (in the condition in which the pressure plate is horizontal) according to the sheet feeder of embodiment 2.

FIG. 14 is a sectional view of the sheet feeder of embodiment 2 (in the condition in which the sheet feed cassette is nearly halfway drawn from the cassette housing part).

FIG. 15 is a sectional view of the sheet feed cassette (in the condition in which the pressure plate is horizontal) according to a sheet feeder of embodiment 3.

FIG. 16 is a top view of the sheet feed cassette (in the condition in which the pressure plate is horizontal) according to the sheet feeder of embodiment 3.

FIG. 17 is a sectional view of the sheet feeder of embodiment 3 (in the condition in which the sheet feed cassette is nearly halfway drawn from the cassette housing part).

DETAILED DESCRIPTION OF THE PREFERRED EMBODIMENTS

Embodiment 1

Figure 1:
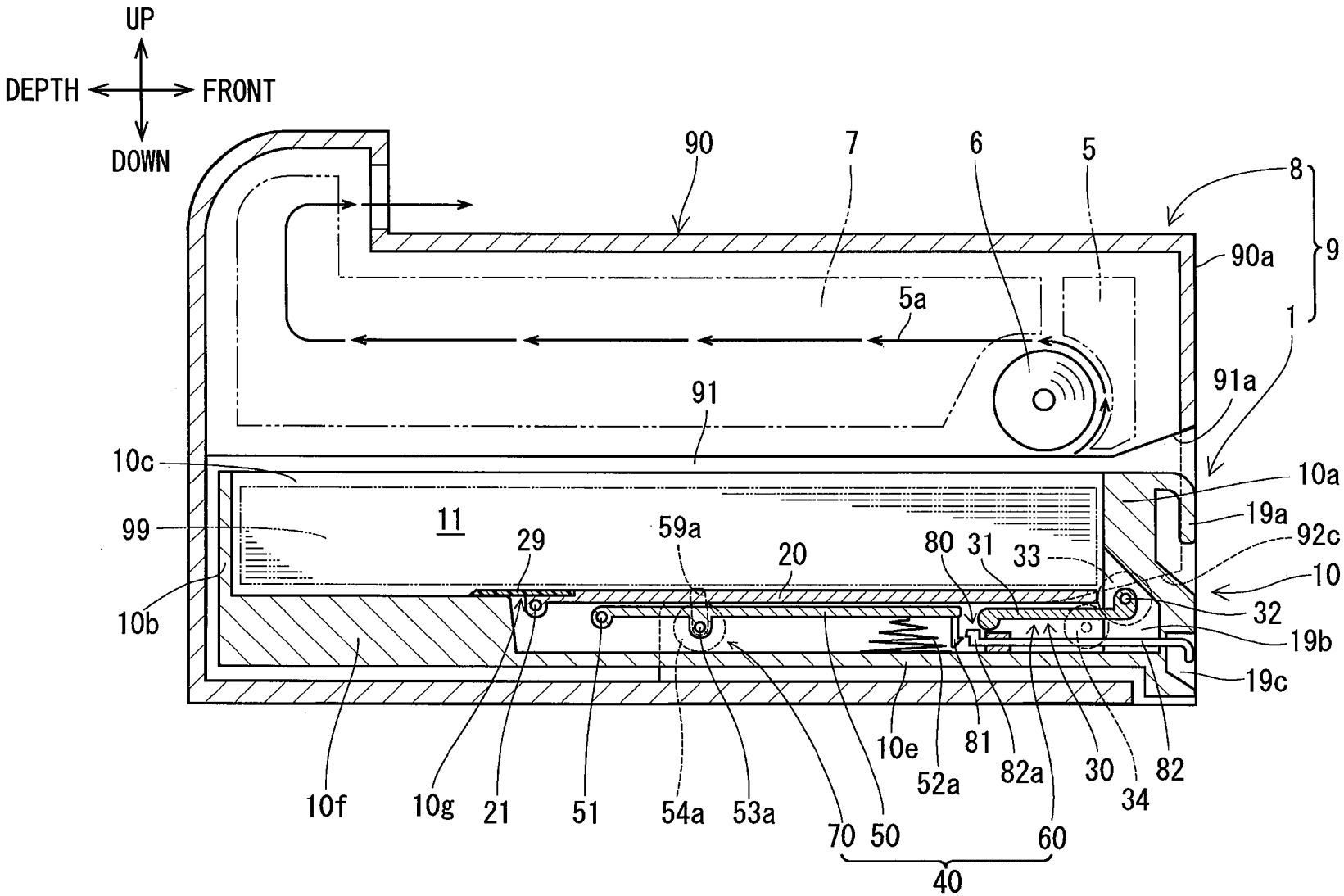
In FIGS. 1, 2, 4 to 17, the right side is the front side and the left side is the depth side.
Figure 2:
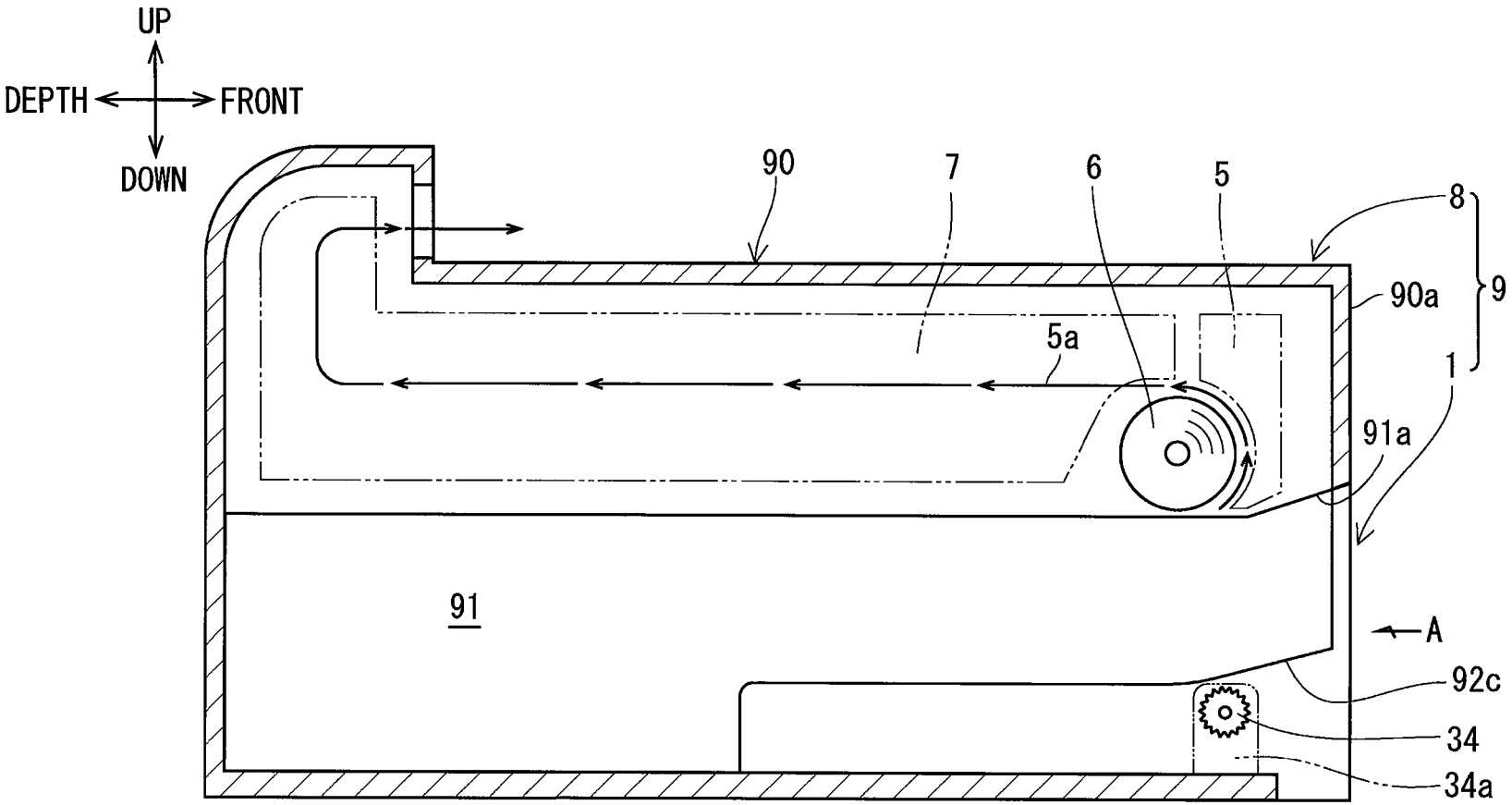
Figure 3:
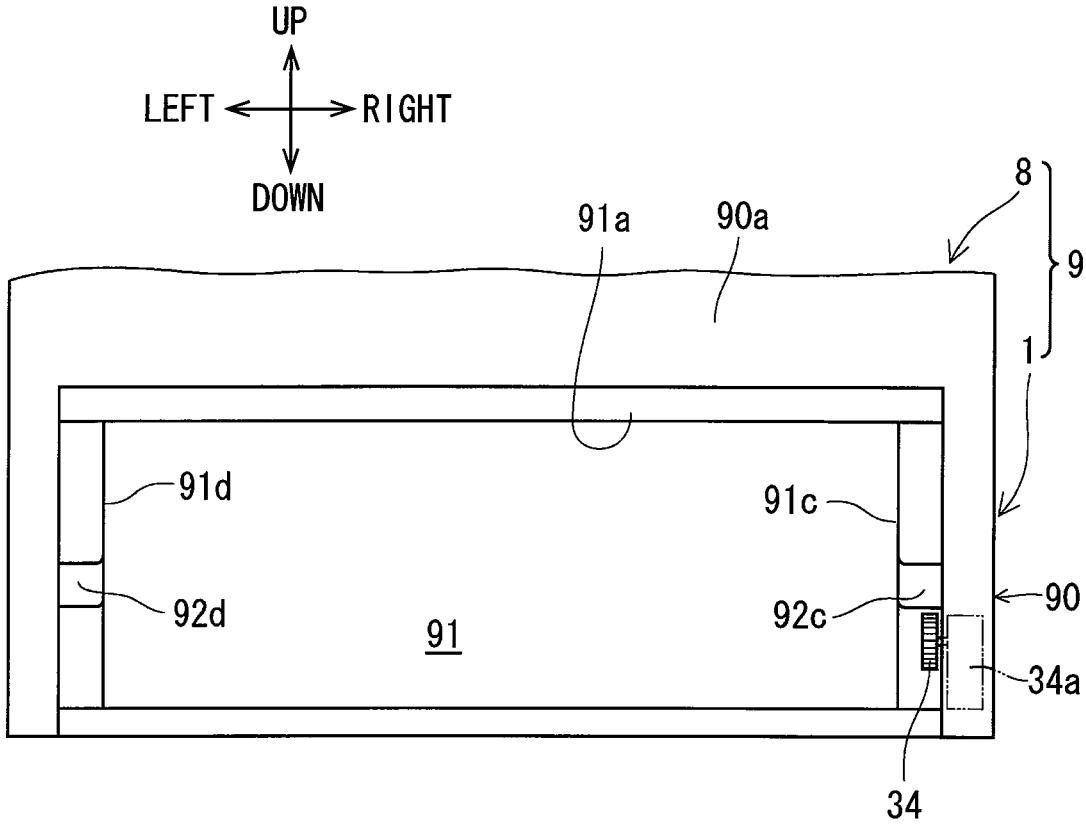
FIG. 3 is an elevational view along an arrow A in FIG. 2 according to the sheet feeder of embodiment 1.

As shown in FIGS. 1 to 3, a sheet feeder 1 of embodiment 1 configures a printer 9 as an image forming apparatus together with a printer main body 8.

The printer main body 8 includes a housing 90 having a substantially rectangular parallelepiped shape, and an image forming unit 7 provided in the upper part within the housing 90. The image forming unit 7, though details of which are not shown, adopts a general image forming system including electrophotographic, thermal, inkjet, or other systems.

The sheet feeder 1 includes the housing 90 in common use with the printer main body 8, a sheet feed cassette 10, a pressure plate 20, a pressure mechanism 30, and a pressure plate regulation mechanism 40.

The housing 90 has a cassette housing part 91. The cassette housing part 91 is located below the image forming unit 7 and recessed horizontally from the front surface 90*a* of the housing 90 toward the depth direction. Further, a pick-up roller 6 that is driven rotationally about a horizontal axis perpendicular to the depth direction is provided in the upper part at the front surface 90*a* side within an opening 91*a* of the cassette housing part 91. Furthermore, a sheet feed assistance part 5 is provided in front of the pick-up roller 6, though the details are not shown. The sheet feed assistance part 5 has a separation roller mechanism that separates sheets of paper 99 one by one, a paper dust collection roller mechanism, a turning mechanism that turns the sheet of paper 99 along the pick-up roller 6 and guides it in the depth direction, etc.

Figure 5:
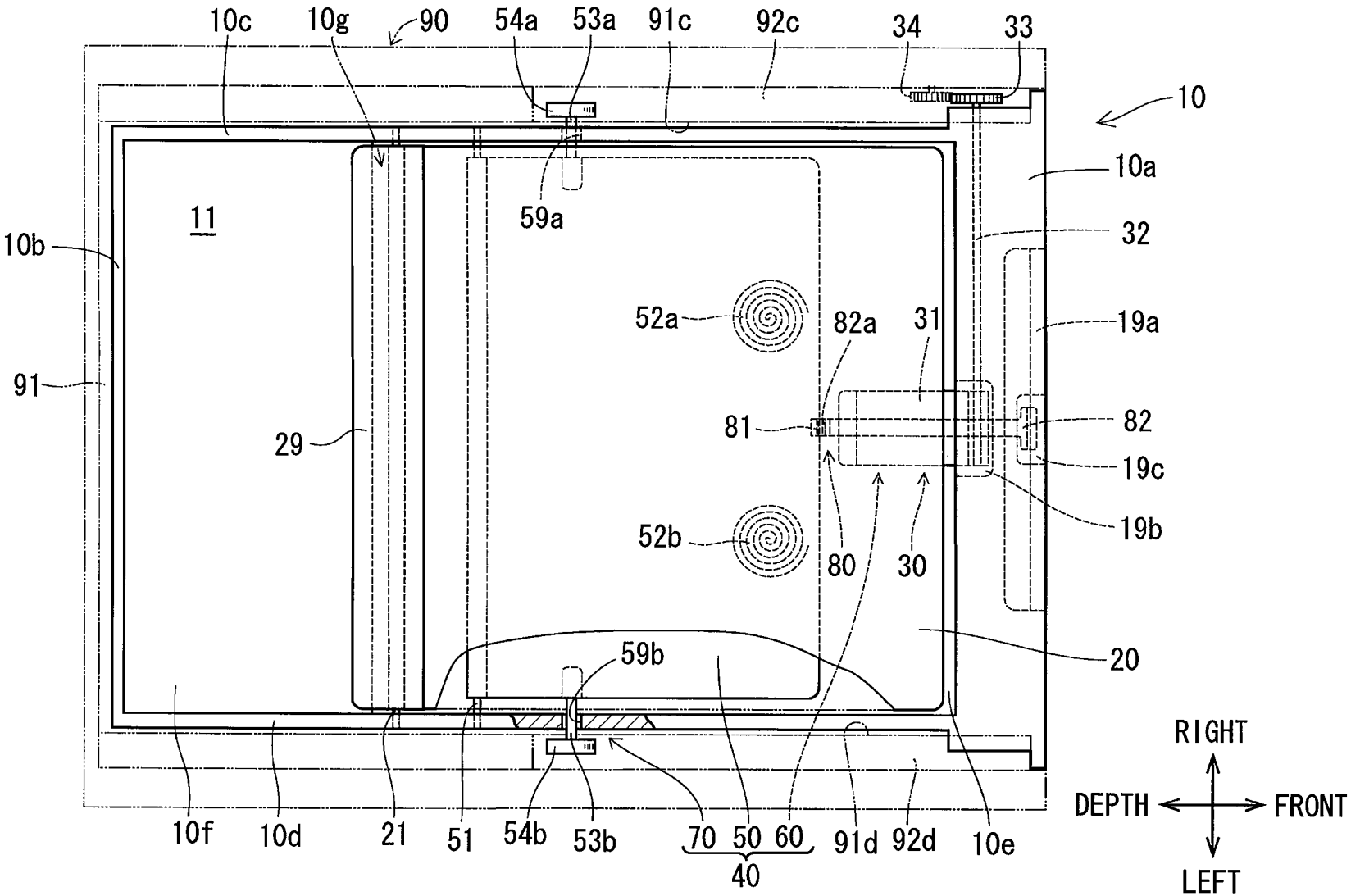

As shown in FIGS. 3 and 5, guide rails 92*c*, 92*d*, the details of which will be described later, are formed in the inner walls 91*c*, 91*d* in the width direction of the cassette housing part 91. The depth parts of the guide rails 92*c*, 92*d* are downward horizontal surfaces, and the front parts are downwardly inclined surfaces that continue with the horizontal surfaces and rise frontward. Further, a drive gear 34, the details of which will be described later, is provided in one inner wall 91*c* in the width direction of the cassette housing part 91.

Figure 4:
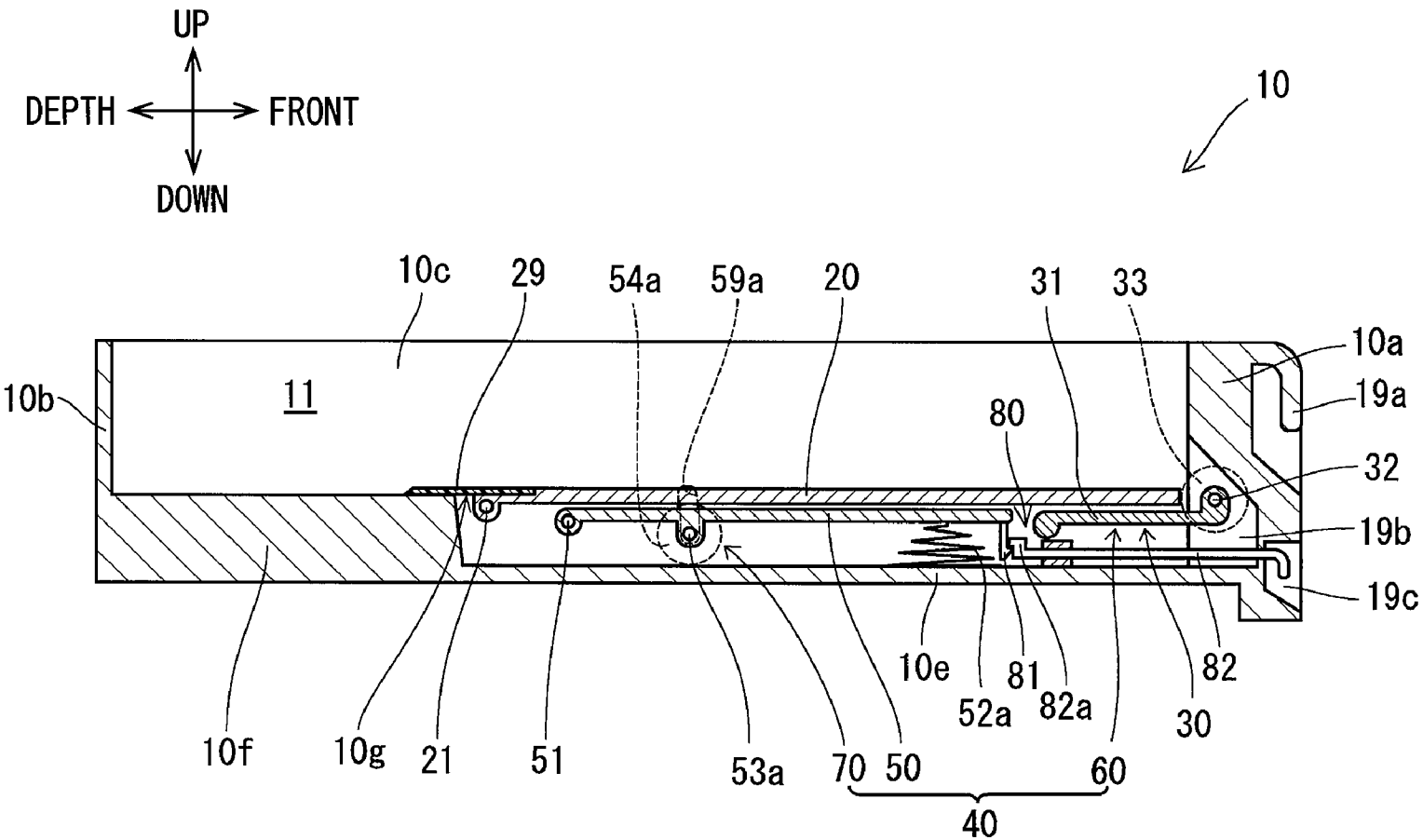
Figure 11:
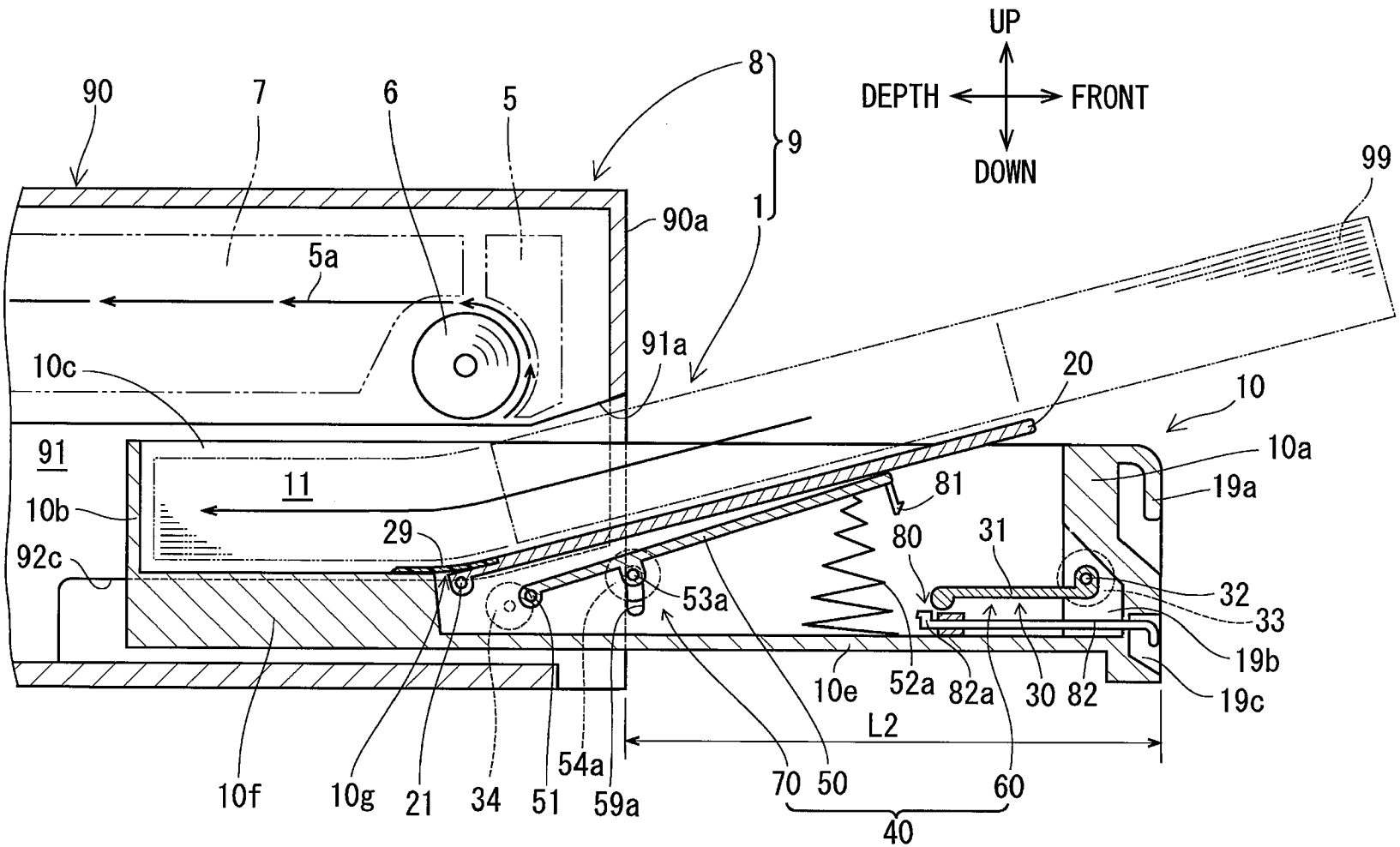

As shown in FIGS. 4 and 5, the sheet feed cassette 10 has a box shape with an open top and a front wall part 10*a*, a depth wall part 10*b*, side wall parts 10*c*, 10*d*, a front bottom part 10*e*, and a depth bottom part 10*f*. The front bottom part 10*e* is recessed deeper than the depth bottom part 10*f*. At the front surface side of the front wall part 10*a*, a handle 19*a* that can catch fingers when the sheet feed cassette 10 is drawn is formed. Further, the sheet feed cassette 10 can be inserted from the opening 91*a* of the cassette housing part 91 in the depth direction and housed within the cassette housing part 91 as shown in FIG. 1, drawn from the cassette housing part 91 as shown in FIG. 11, and further, detached from the cassette housing part 91 as shown in FIGS. 2 to 4.

Figure 6:
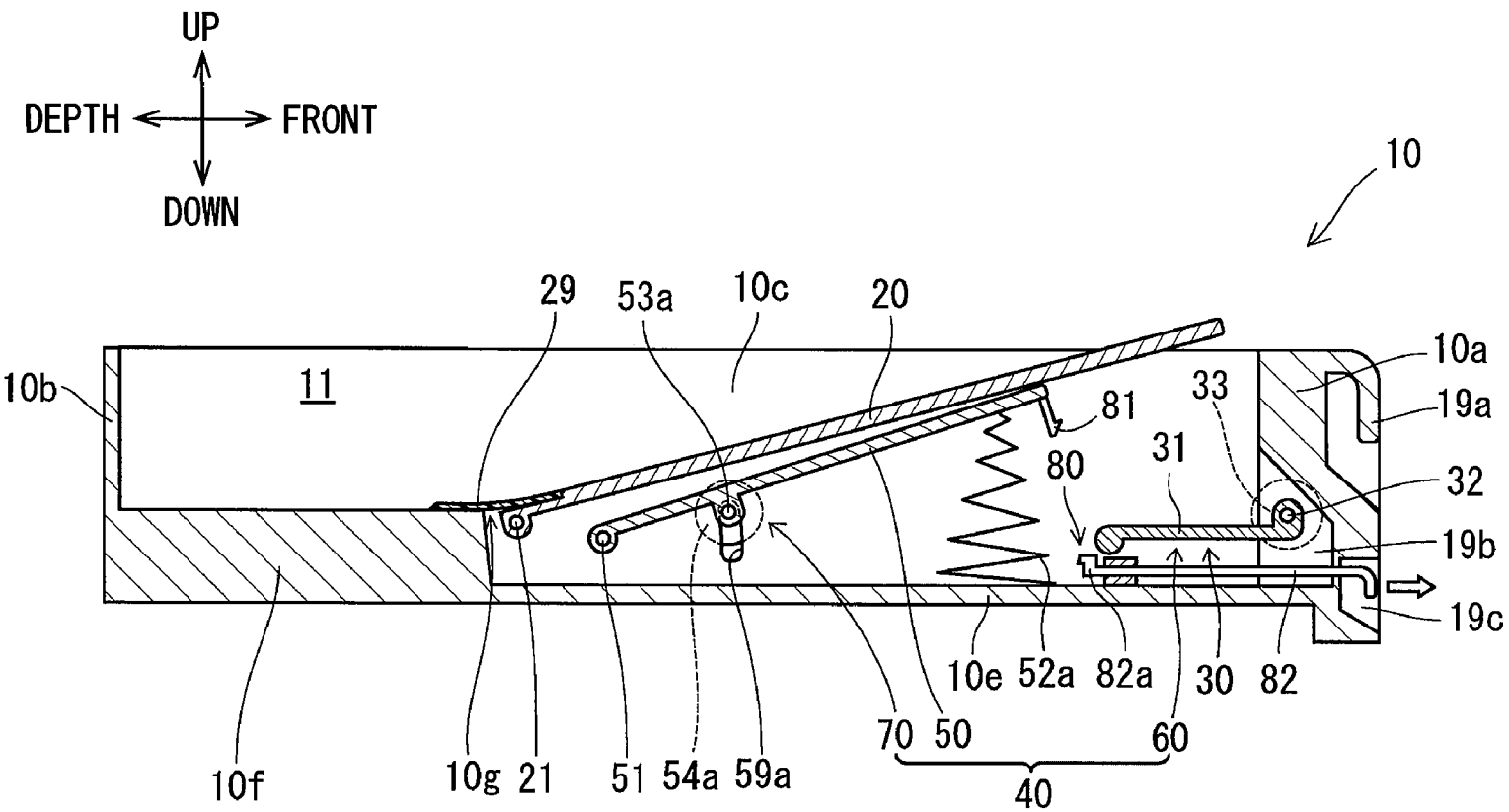

The pressure plate 20 formed of a substantially rectangular metal thin plate is provided in the sheet feed cassette 10. The front edge of the pressure plate 20 is located near the inner surface of the front wall part 10*a*. On the other hand, the depth edge of the pressure plate 20 is journaled by a first pivot 21 in parallel with the horizontal axis provided near the front edge of the depth bottom part 10*f*. Accordingly, the pressure plate 20 is pivotable about the first pivot 21 from the horizontal state in which the plate forms substantially the same plane with the depth bottom part 10*f* as shown in FIG. 4 to the downwardly inclined state in which the plate descends toward the depth direction as shown in FIG. 6. The pressure plate 20 pivots according to the pressure mechanism 30 or the pressure plate regulation mechanism 40, which will be described later.

The space defined by the front wall part 10*a*, the depth wall part 10*b*, the side wall parts 10*c*, 10*d*, and the depth bottom part 10*f* of the sheet feed cassette 10 as well as the upper surface of the pressure plate 20 is a holding chamber 11 that can store stacked sheets of paper 99.

To the part between the upper surface at the first pivot 21 side in the pressure plate 20 (that is, the depth edge of the pressure plate 20) and the depth bottom part 10*f* that forms part of the bottom surface of the holding chamber 11, a sheet member 29 that covers a gap 10*g* produced between them is attached. The sheet member 29 is an elastically deformable thin resin sheet in a belt shape. The front edge of the sheet member 29 is fixed so as not to produce irregularities on the upper surface at the first pivot 21 side in the pressure plate 20, and the depth edge of the sheet member 29 is in contact with the upper surface of the depth bottom part 10*f*. Accordingly, as shown in FIG. 6, even when the pressure plate 20 pivots from the horizontal state to the downwardly inclined state toward the depth direction, the sheet member 29 can elastically deform to cover the gap 10*g* between the pressure plate 20 and the depth bottom part 10*f* with a smooth curved surface.

As shown in FIGS. 4 and 5, in the space defined by the lower surface of the pressure plate 20 and the front bottom part 10*e*, the pressure mechanism 30 (except the drive gear 34 described as below), the pressure plate regulation mechanism 40, and a pressure plate positioning mechanism 80 are provided.

The pressure mechanism 30 has a lever 31, a rotating shaft 32, and a driven gear 33 provided at the sheet feed cassette 10 side, and the drive gear 34 provided at the housing 90 side.

More specifically, the rotating shaft 32 is buried rotatably about the horizontal axis perpendicular to the depth direction within the front wall part 10*a* of the sheet feed cassette 10. Further, one end of the rotating shaft 32 projects out of the sheet feed cassette 10 and the driven gear 33 is fixed thereto. On the other hand, the other end of the rotating shaft 32 projects into a recessed portion for lever 19*b* formed at the inner center of the front wall part 10*a*, and the lever 31 is fixed thereto. The lever 31 extends from the other end of the rotating shaft 32 in the depth direction to position the depth edge of the lever 31 below the front side of the pressure plate 20.

Figure 7:
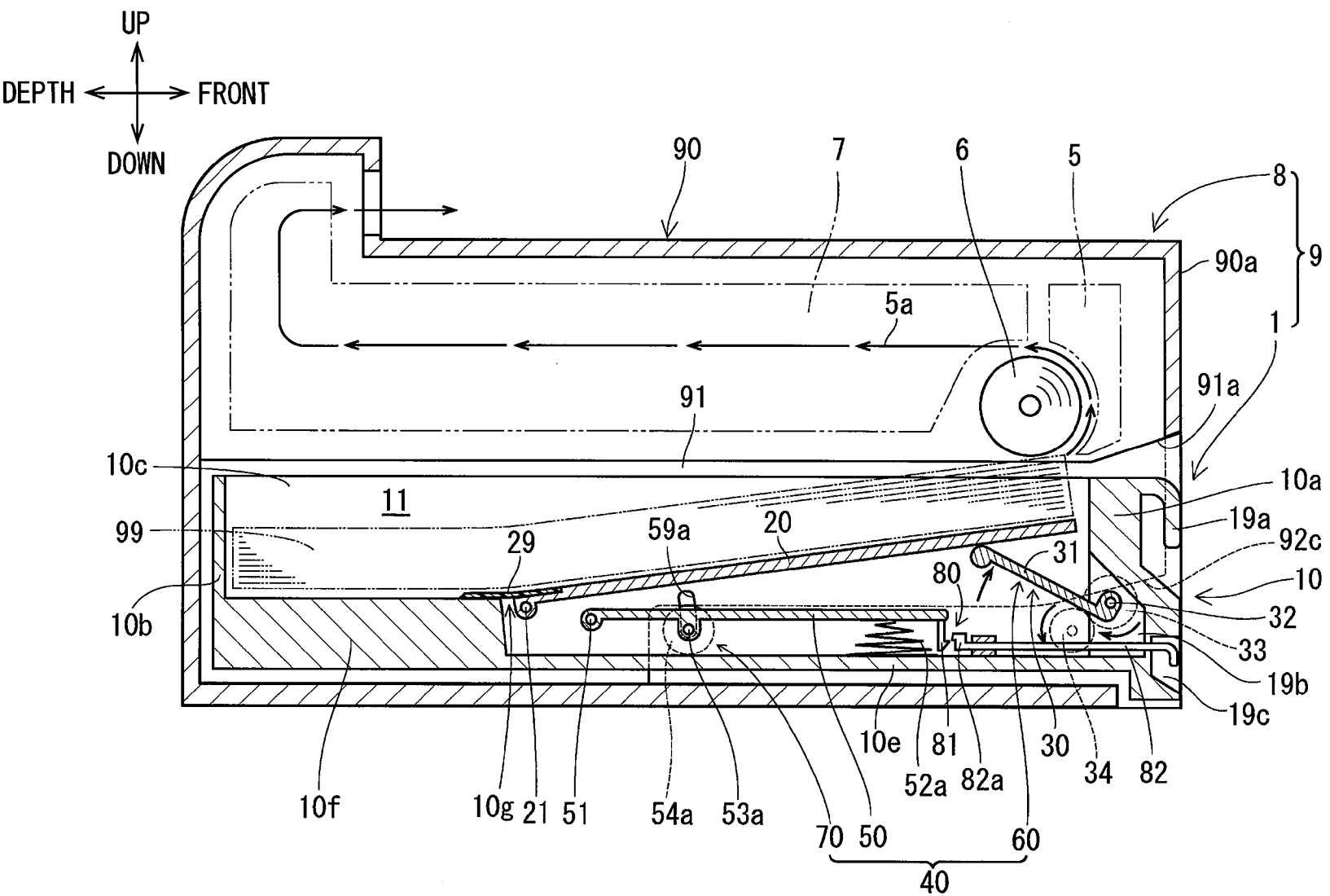
Figure 8:
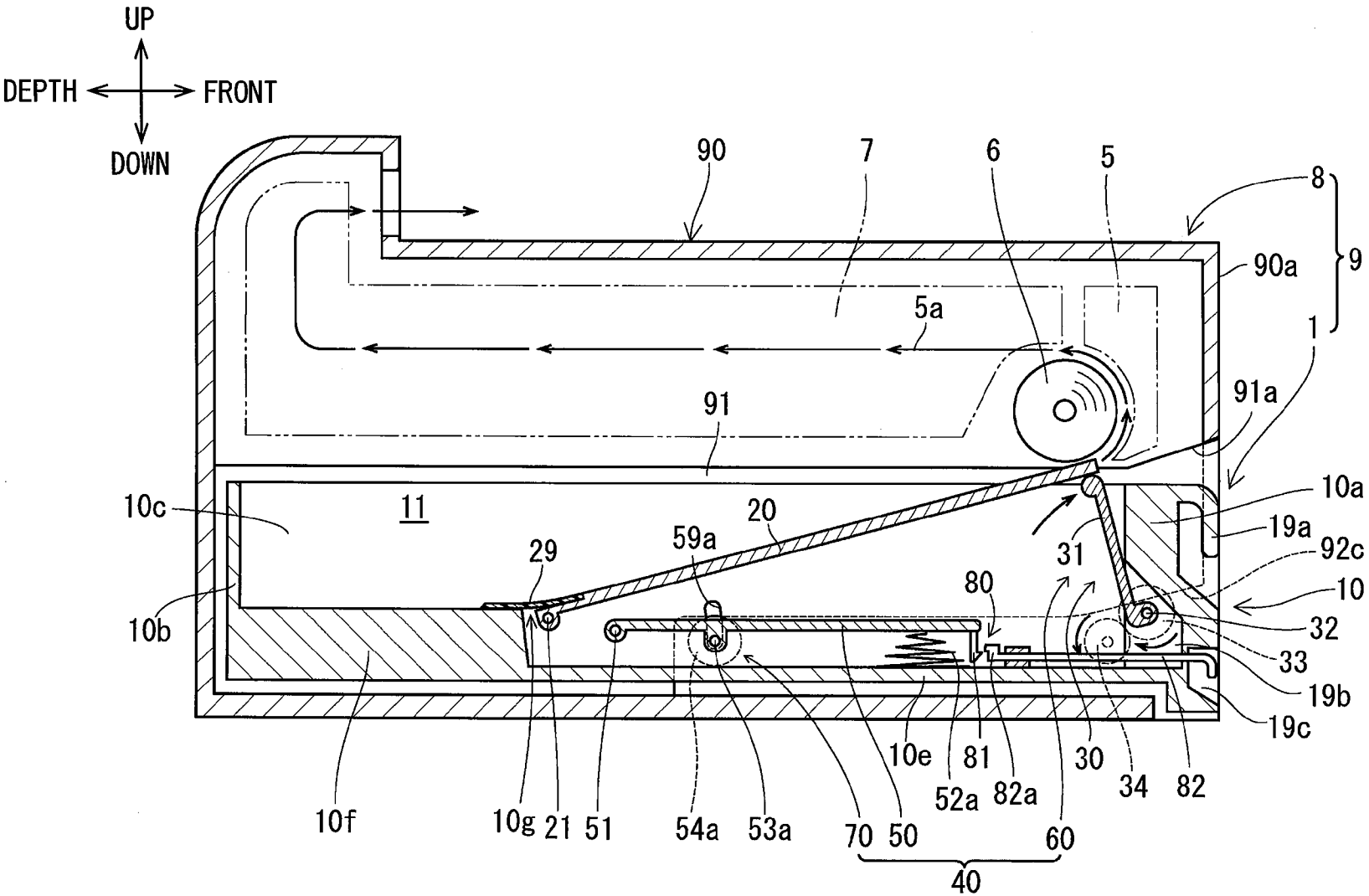
Figure 9:
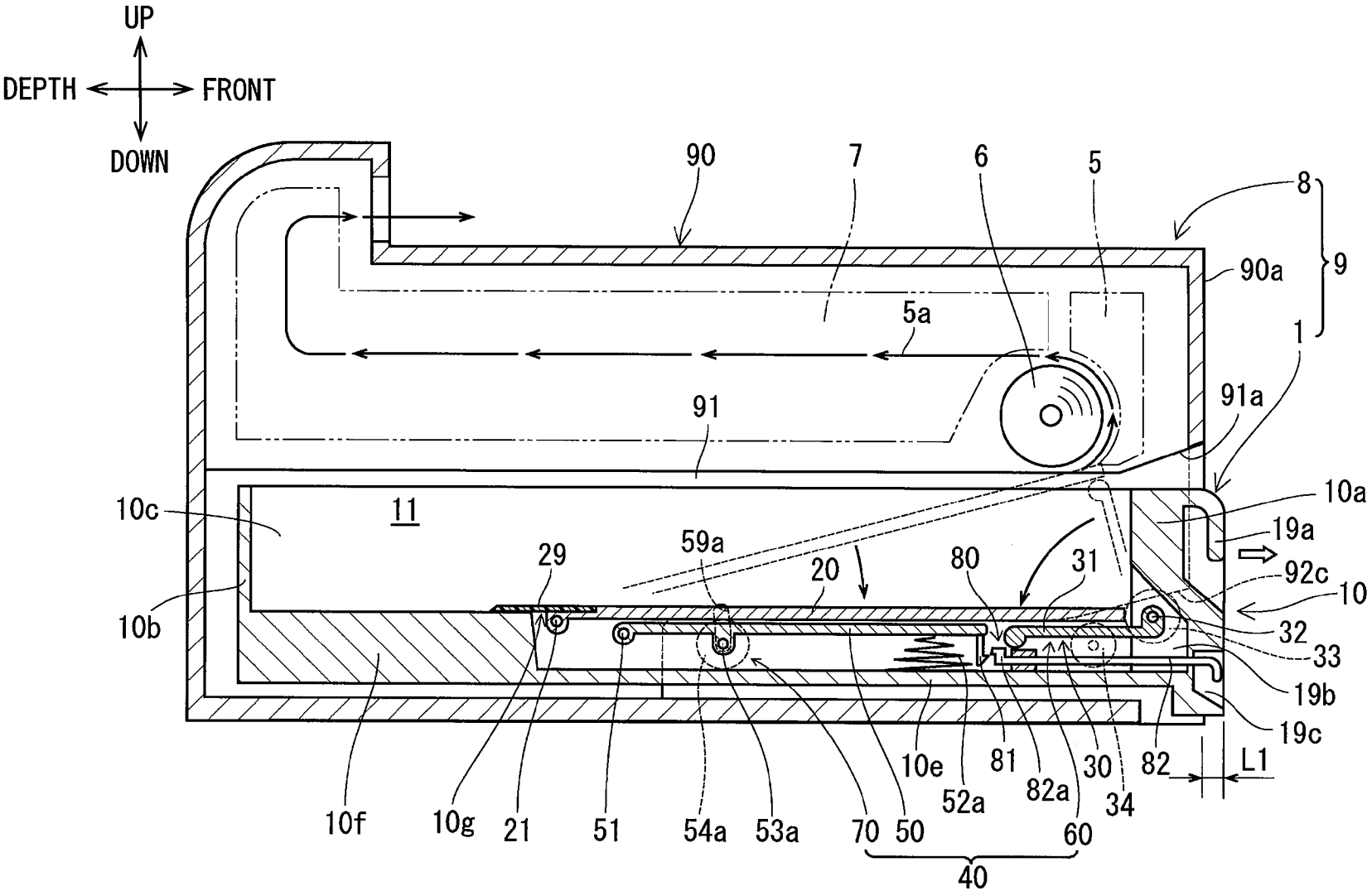

As shown in FIGS. 3 and 5, the drive gear 34 is provided to project from the inner wall 91*c* within the cassette housing part 91. When the sheet feed cassette 10 is housed in the cassette housing part 91, the drive gear 34 meshes with the driven gear 33 as shown in FIGS. 1 and 5. Further, the drive gear 34 is controlled by a pressure mechanism control unit 34*a* including a sensor that senses that the sheet feed cassette 10 is pushed into the cassette housing part 91, a sensor for remaining amount of paper, an electric motor, etc. Accordingly, when the drive gear 34 rotates in the condition in which the sheet feed cassette 10 is housed in the cassette housing part 91, the driven gear 33 and the rotating shaft 32 also rotate to pivot the lever 31. Further, when the lever 31 pivots, the depth edge of the lever 31 pushes up the front side of the pressure plate 20 from below, and thereby, the pressure plate 20 can be downwardly inclined toward the depth direction as shown in FIGS. 7 and 8.

The pressure plate regulation mechanism 40 includes a first link 60, a supporting member 50, and a second link 70.

The first link 60 commonly uses component members with the pressure mechanism 30 and includes the lever 31, the rotating shaft 32, the driven gear 33, and the drive gear 34. Further, in the condition in which the pressure plate 20 is inclined as shown in FIGS. 7 and 8, when the sheet feed cassette 10 is drawn from the cassette housing part 91 slightly by the length L1 (L1=about 1 mm to several millimeters), the driven gear 33 and the drive gear 34 are separated and no longer meshed. Further, the driven gear 33 that has been restrained in rotation by the drive gear 34 becomes free to rotate. Accordingly, the force of the lever 31 to push up the pressure plate 20 no longer acts and the pressure plate 20 and the lever 31 return from the inclined state to the horizontal state due to the weight of the pressure plate 20 itself and the weight of the sheets of paper 99. Thus, the first link 60 can reduce the angle of inclination of the pressure plate 20 so that the sheets of paper 99 on the pressure plate 20 or the pressure plate 20 and the pick-up roller 6 may be separated when the sheet feed cassette 10 is drawn from the cassette housing part 91.

As shown in FIGS. 4 and 5, the supporting member 50 is formed of a metal thin plate having a substantially rectangular shape smaller than that of the pressure plate 20, and provided underneath the pressure plate 20 to overlap with each other. The depth edge of the supporting member 50 is journaled by a second pivot 51 provided near the first pivot 21 in parallel with the first pivot 21 and pivotable about the second pivot 51. On the other hand, two coil springs 52*a*, 52*b* are provided between the front lower surface of the supporting member 50 and the front bottom part 10*e*, and energize the front side of the supporting member 50 to push it upwardly. A pair of guide roller shafts 53*a*, 53*b* is provided at edges of the supporting member 50 in the width direction. The guide roller shafts 53*a*, 53*b* project through slots 59*a*, 59*b* formed in the side wall parts 10*c*, 10*d* of the sheet feed cassette 10 to the outside, and guide rollers 54*a*, 54*b* are rotatably supported on the respective ends thereof.

The second link 70 includes the guide roller shafts 53*a*, 53*b*, the guide rollers 54*a*, 54*b*, the two coil springs 52*a*, 52*b*, and the above described guide rails 92*c*, 92*d*. Further, when the sheet feed cassette 10 is drawn from the cassette housing part 91, the angle of inclination of the supporting member 50 and the pressure plate 20, which has been reduced to the horizontal state by the first link 60, can be increased by the second link 70 again in the following manner.

First, when the sheet feed cassette 10 is housed in the cassette housing part 91 as shown in FIG. 1, the guide rollers 54*a*, 54*b* energized upwardly by the coil springs 52*a*, 52*b* are in contact with the horizontal surface at the depth side of the guide rails 92*c*, 92*d* from below as shown by (a) in FIG. 10. Concurrently, the supporting member 50 is in the horizontal state as shown in FIG. 1.

Figure 10:
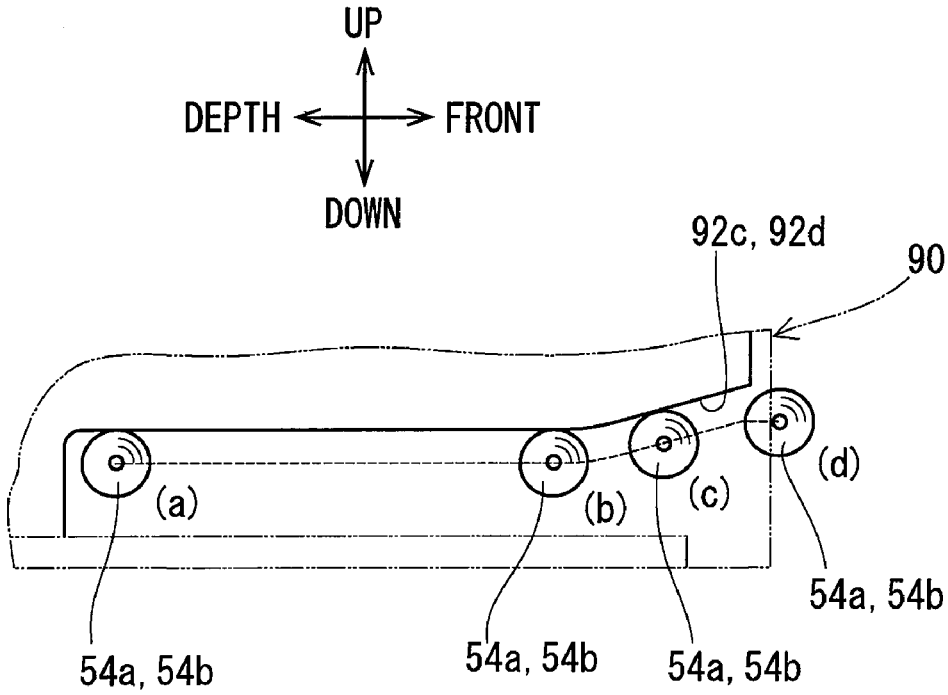

Then, as the sheet feed cassette 10 is being drawn from the cassette housing part 91, the guide rollers 54*a*, 54*b* are being brought into contact with the inclined surface at the front side from the horizontal surface at the depth side of the guide rails 92*c*, 92*d* and gradually rise as shown by (b) and (c) in FIG. 10. With the rise, the angle of inclination of the supporting member 50 increases.

Then, as shown in FIG. 11, when the sheet feed cassette 10 is drawn from the cassette housing part 91 by the length L2 (L2 is about one-half of the length of sheets of paper 99 in the depth direction) less than the length of sheets of paper 99 in the depth direction (brought into a half-open state) as shown in FIG. 11, the guide rollers 54*a*, 54*b* separate from the inclined surface at the front side of the guide rails 92*c*, 92*d* as shown by (d) in FIG. 10, and the supporting member 50 is held at the maximum angle of inclination.

Thus, when the sheet feed cassette 10 is drawn from the cassette housing part 91 by the length L2 less than the length of sheets of paper 99 in the depth direction, the second link 70 can increase the angle of inclination of the supporting member 50 and push up the pressure plate 20 from below by the front edge of the supporting member 50 to downwardly incline the pressure plate 20 toward the depth direction. Concurrently, a clearance having a height that may prevent interference of the sheets of paper 99 being loaded is secured between the inclined pressure plate 20, and the pick-up roller 6 and the cassette housing part 91 as shown in FIG. 11. When the sheet feed cassette 10 is pushed into the cassette housing part 91, the second link 70 performs the reverse operation to the above described operation.

As shown in FIGS. 4 and 5, the pressure plate positioning mechanism 80 has a latch member 81 provided to project downwardly from the center of the front edge of the supporting member 50, and a locking member 82 that extends from a recessed portion for locking member 91*c* formed in the lower part of the front surface of the front wall part 10*a* in the depth direction in a rod shape slidable in the depth direction. A locking lug 82*a* is formed on the depth end of the locking member 82. Further, as shown in FIG. 4, when the supporting member 50 is horizontal, the locking member 82 is slid in the depth direction, so that the locking lug 82*a* may lock the latch member 81. Accordingly, as shown in FIGS. 6 and 11, when the locking member 82 is drawn to the front side (not slid in the depth direction) and the guide rollers 54*a*, 54*b* are not in contact with the guide rails 92*c*, 92*d*, the locking lug 82*a* separates from the latch member 81, the supporting member 50 is energized by the coil springs 52*a*, 52*b* and downwardly inclined in the depth direction, and the pressure plate 20 is pushed up by the supporting member 50 and downwardly inclined in the depth direction. From the state, the user pushes down the pressure plate 20 to the horizontal state, and then, the supporting member 50 is also pushed down and the latch member 81 descends. Further, the user slides the locking member 82 in the depth direction, and then, the locking lug 82*a* locks the latch member 81 to position the supporting member 50 in the horizontal state as shown in FIG. 4. That is, the pressure plate positioning mechanism 80 can indirectly position the pressure plate 20 in the horizontal state (i.e., the state along the bottom surface of the holding chamber 11). As a modified example of the embodiment, an elastic member that energizes the locking member 82 in the direction to slide the locking member 82 in the depth direction may be provided. By the configuration, the locking member 82 can be slid in the depth direction by the elastic force of the elastic member to lock the latch member 81 with the locking lug 82*a* instead of the user sliding the locking member 82 in the depth direction. Accordingly, the user can position the supporting member 50 in the horizontal state only by pushing down the pressure plate 20 without operating the locking member 82. Therefore, the operation is performed more easily and the usability is improved. The elastic member may be a metal spring or resin spring.

Furthermore, as shown in FIG. 1, when the sheet feed cassette 10 is housed in the cassette housing part 91, if the locking member 82 is slid in the depth direction and the supporting member 50 is positioned in the horizontal state, the pressure plate positioning mechanism 80 does not prevent the inclination of the pressure plate 20 by the operation of the pressure mechanism 30 because it only indirectly positions the pressure plate 20.

In the sheet feeder 1 of embodiment 1 having the above described configuration, sheets of paper 99 are fed to the printer 9 and sheets of paper 99 are loaded in the sheet feed cassette 10 as below.

First, as shown in FIG. 1, when many sheets of paper 99 are held in the holding chamber 11 of the sheet feed cassette 10, the printer 9 is activated and a command is issued from a control unit (not shown), then, the drive gear 34 is rotated by the pressure mechanism control unit 34*a*, and accordingly, the lever 31 pivots to push up the pressure plate 20 from below. Thus, the pressure mechanism 30 increases the angle of inclination of the pressure plate 20 and presses the sheets of paper 99 against the pick-up roller 6. When the pick-up roller 6 rotates according to the command from the control unit, the uppermost sheet of paper 99 is fed one by one to the image forming unit 7 through the sheet feed assistance part 5 as shown by a sheet feed path 5*a*, and images are formed thereon and the sheets of paper 99 are ejected to the outside. Concurrently, the pressure mechanism 30 increases the angle of inclination of the pressure plate 20 and presses the sheets of paper 99 against the pick-up roller 6 constantly with an optimum pressing force as the sheets of paper 99 within the holding chamber 11 are reduced.

When the sheets of paper 99 within the holding chamber 11 are reduced as shown in FIG. 7 or there is no sheet of paper as shown in FIG. 8 after the sheets of paper 99 are fed from the sheet feeder 1, the user loads the sheets of paper 99 in the sheet feeder 1.

In this regard, when the user draws the sheet feed cassette 10 from the cassette housing part 91 slightly by the length L1, the driven gear 32 and the drive gear 34 of the first link 60 are separated and the driven gear 32 becomes freely rotatable, and then, the pressure plate 20 and the lever 31 moves downwardly due to the weight of the pressure plate 20 itself. In this manner, the first link 60 reduces the angle of inclination of the pressure plate 20 to turn the pressure plate 20 into the horizontal state and separates the sheets of paper 99 on the pressure plate 20 or the pressure plate 20 from the pick-up roller 6. Accordingly, no sheet of paper 99 remains between the upper most sheet of paper 99 remaining in the holding chamber 11 of the sheet feed cassette 10 and the pick-up roller 6 or in the holding chamber 11, and a clearance is produced between the pressure plate 20 and the pick-up roller 6. Consequently, even when the user draws the sheet feed cassette 10 further, the sheets of paper 99 remaining on the pressure plate 20 or the pressure plate 20 may not rub against the pick-up roller 6.

Then, as the user draws the sheet feed cassette 10 further from the cassette housing part 91, the positional relationships between the guide rails 92*c*, 92*d* and the guide rollers 54*a*, 54*b* of the second link 70 change to increase the angle of inclination of the supporting member 50 as shown in FIG. 10, and accordingly, the angle of inclination of the pressure plate 20 is increased again. In this manner, when the sheet feed cassette 10 is drawn from the cassette housing part 91 by the length L2 less than the length of sheets of paper 99 in the depth direction, the second link 70 may downwardly incline the pressure plate 20 toward the depth direction again as shown in FIG. 11.

Next, the user inserts the sheets of paper 99 to be loaded into the sheet feed cassette 10 from above the front side of the holding chamber 11 toward the depth direction. In this regard, the sheets of paper 99 are guided by the remaining uppermost sheet of paper 99 or the pressure plate 20 and easily stacked in the holding chamber 11 without rubbing against the pick-up roller 6. Further, when the sheets of paper 99 are loaded along the inclined pressure plate 20, the sheets of paper 99 are not caught by the gap 10*g* because the sheets of paper 99 are inserted slidingly on the upper surface of the sheet member 29. Thus, in the sheet feeder 1, even if the sheet feed cassette 10 is not completely drawn from the cassette housing part 91 of the housing 90, the sheets of paper 99 can be easily and reliably loaded along the pressure plate 20 downwardly inclined toward the depth direction in the holding chamber 11 of the sheet feed cassette 10.

Further, in the condition of FIG. 11, if the user pushes down the pressure plate 20 to the horizontal state and further slides the locking member 82 in the depth direction, the locking lug 82*a* of the locking member 82 engages with the latch member 81 of the supporting member 50 and the supporting member 50 is positioned in the horizontal state. Consequently, also the pressure plate 20 is indirectly positioned in the horizontal state. Through the pressure plate positioning mechanism 80, the sheet feeder 1 can hold back the sheets of paper 99 rising upwardly by the inclined pressure plate 20 after the sheets of paper 99 are loaded in the sheet feed cassette 10 in the half-open state. Further, when the sheet feed cassette 10 is detached from the sheet feeder 1, the sheets of paper 99 are hard to come out of the holding chamber 11. To unlock the positioning of the pressure plate 20, the locking member 82 may be slid forward to separate the locking lug 82*a* and the latch member 81.

From the condition shown in FIG. 11, the user pushes the sheet feed cassette 10 into the cassette housing part 91, and then, the positional relationships between the guide rails 92*c*, 92*d* and the guide rollers 54*a*, 54*b* of the second link 70 change oppositely to those in the case of drawing the cassette to reduce the angles of inclination of the supporting member 50 and the pressure plate 20. Then, when the sheet feed cassette 10 is completely housed in the cassette housing part 91 as shown in FIG. 1, the driven gear 33 and the drive gear 34 of the pressure mechanism 30 mesh with each other. In this manner, the load of the sheets of paper 99 in the printer 9 is completed and the sheet feeder 1 becomes ready to feed the sheets of paper 99 again.

Here, the sheet feeder 1 of embodiment 1 includes the pressure plate regulation mechanism 40 that separates the sheets of paper 99 on the pressure plate 20 or the pressure plate 20 and the pick-up roller 6 while downwardly inclining the pressure plate 20 toward the depth direction when the sheet feed cassette 10 is drawn from the cassette housing part 91 by the length less than the length of the sheets of paper 99 in the depth direction. Accordingly, in the sheet feeder 1, the sheets of paper 99 can be loaded in the holding chamber 11 of the sheet feed cassette 10 along the pressure plate 20 downwardly inclined toward the depth direction even when the sheet feed cassette 10 is not completely drawn from the cassette housing part 91 as described above.

Therefore, the sheet feeder 1 of embodiment 1 can occupy the smaller space so as not to reduce the work area on the desk or the like.

Further, in the sheet feeder 1, the pressure plate regulation mechanism 40 includes the supporting member 50 that can support the pressure plate 20 from below, and the first link 60 and the second link 70 provided between the housing 90 and the sheet feed cassette 10 for guiding the supporting member 50 while the sheet feed cassette 10 is drawn from the cassette housing part 91 by the length less than the length of the sheets of paper 99 in the depth direction. According to the sheet feeder 1, the conventional sheet feeder can be easily improved to exert effects of the invention only by making small modifications to the pressure plate, the pressure mechanism, etc. thereof, and the rise in manufacturing cost can be suppressed.

Furthermore, in the sheet feeder 1, the first link 60 reduces the angle of inclination of the pressure plate 20 to separate the sheets of paper 99 on the pressure plate 20 or the pressure plate 20 from the pick-up roller 6 when the sheet feed cassette 10 is drawn from the cassette housing part 91, and the second link 70 downwardly inclines the pressure plate 20 toward the depth direction again when the sheet feed cassette 10 is drawn from the cassette housing part 91 by the length less than the length of sheets of paper 99 in the depth direction. Accordingly, in the sheet feeder 1, the effects of the invention can be realized more reliably by switching from the pressure mechanism 30 to the first link 60, and then, switching from the first link 60 to the second link 70, and the conventional sheet feeder can be improved more easily.

Moreover, in the sheet feeder 1, since the supporting member 50 is the plate-like member provided between the pressure plate 20 and the front bottom part 10*e* as part of the bottom surface of the holding chamber 11, the thickness of the pressure plate 20 and the supporting member 50 can be made thinner and the reduce in size of the holding chamber 11 of the sheet feed cassette 10 can be suppressed. Thereby, a large number of sheets of paper 99 can be held within the sheet feed cassette 10.

In addition, the printer 9 as the image forming apparatus including the sheet feeder 1 can occupy the smaller space so as not to reduce the work area on the desk or the like.

Embodiment 2

Figure 12:
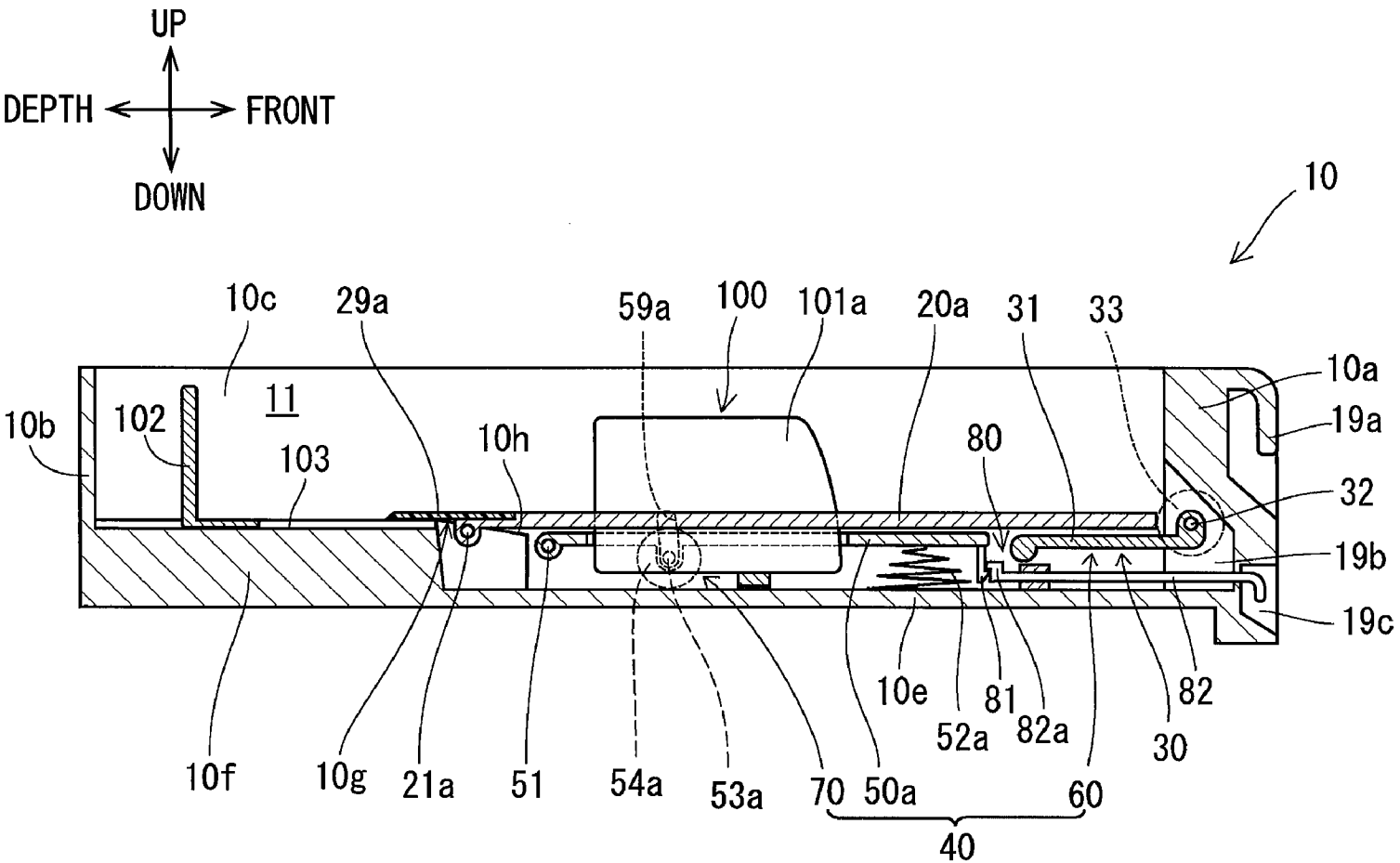
Figure 13:
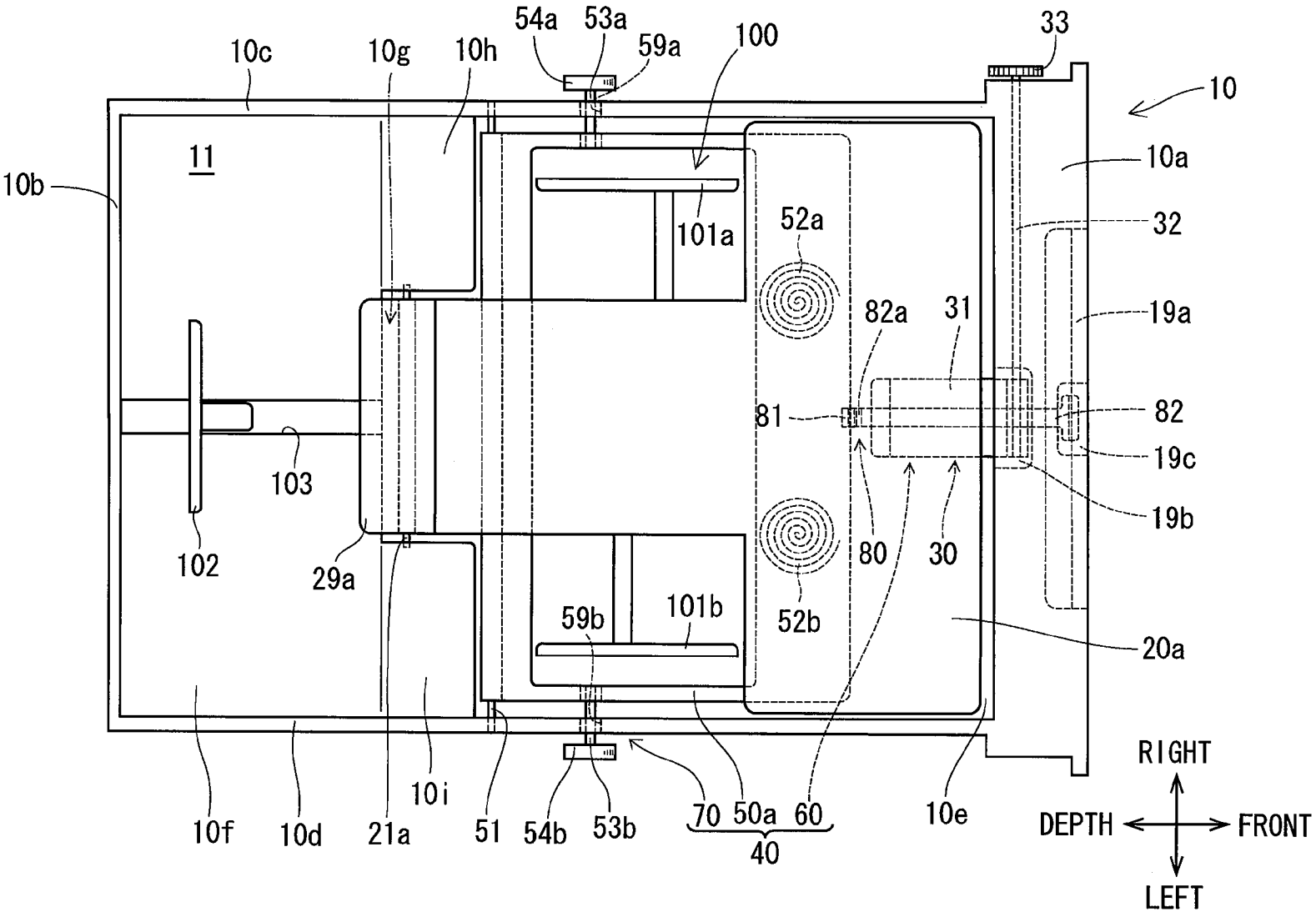
Figure 14:
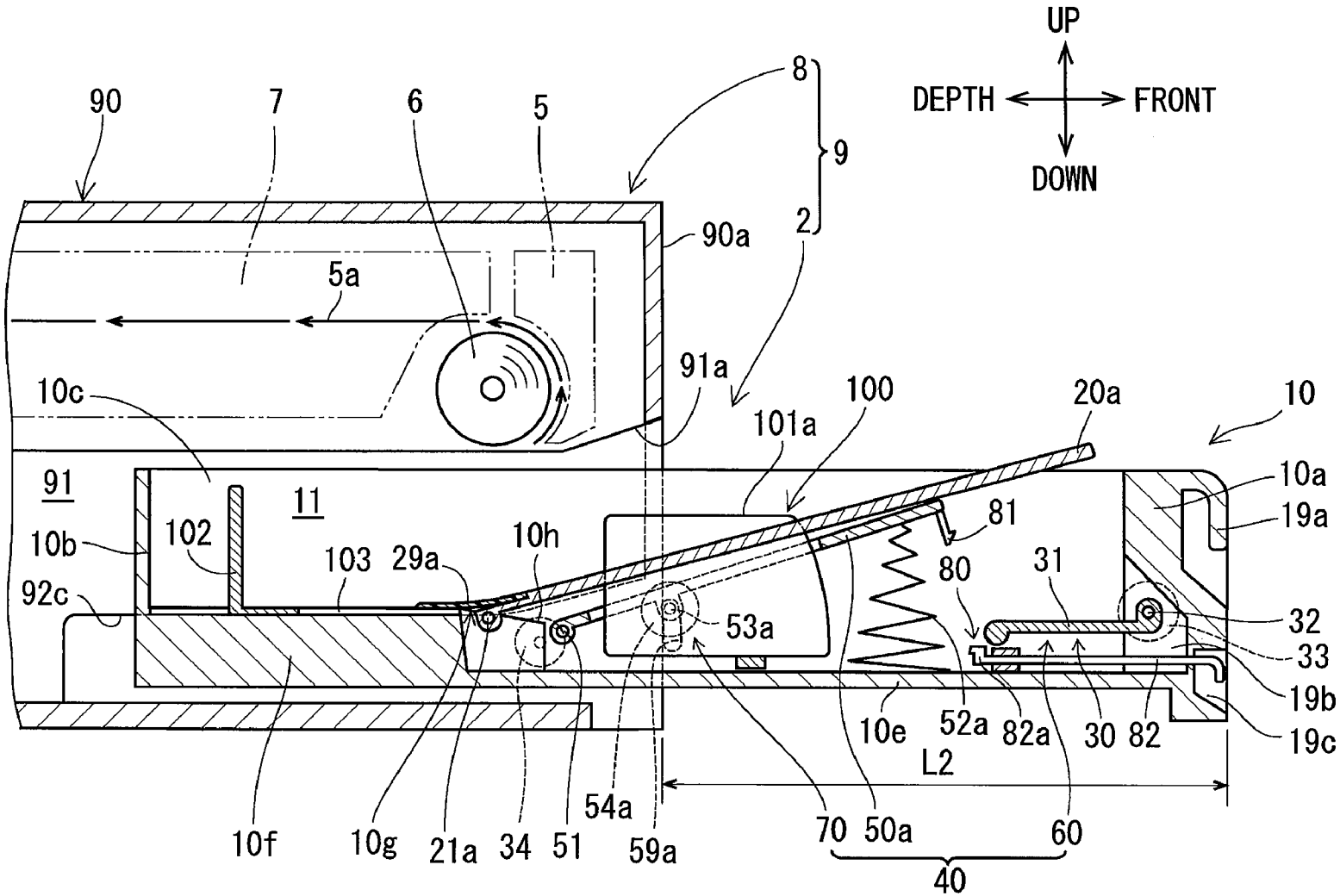

As shown in FIGS. 12 to 14, a sheet feeder 2 of embodiment 2 includes a sheet width regulation mechanism 100 provided on the bottom surface of the holding chamber 11 (on the upper surface of the front bottom part 10*e*) of the sheet feeder 1 of embodiment 1, a depth direction regulating plate 102 provided on the upper surface of the depth bottom part 10*f*, a pressure plate 20*a* having a T-shape, and a supporting member 50*a* having a "rectangular frame" shape. The other configuration is the same as that of the sheet feeder 1 of embodiment 1, and the description thereof will omitted.

The sheet width regulation mechanism 100 has a pair of width direction regulating plates 101*a*, 101*b*. The width direction regulating plates 101*a*, 101*b* are disposed to face each other at both sides on the upper surface of the front bottom part 10*e* in the width direction, and slidable in the width direction by a general sliding mechanism or the like (not shown).

The pressure plate 20*a* has a front side corresponding to an upper lateral part of the T-shape and a depth side corresponding to a lower longitudinal part of the T-shape, and the depth side of itself is narrower than the sliding range of the width direction regulating plates 101*a*, 101*b* of the sheet width regulation mechanism 100. Accordingly, the pressure plate 20*a* has the shape that does not interfere with the width direction regulating plates 101*a*, 101*b* when the width direction regulating plates 101*a*, 101*b* slide to accommodate sheets of paper of different sizes. In addition to the shorter width of the depth side of the pressure plate 20*a*, the widths of a first pivot 21*a* and a sheet member 29*a* are also made shorter. Further, extending surfaces 10*h*, 10*i* located at both ends of the depth edge of the pressure plate 20*a* and extending forward are formed from the front end of the depth bottom part 10*f*. The extending surfaces 10*h*, 10*i* are guides that, when a wider sheet of paper is inserted along the inclined pressure plate 20*a*, if the both depth ends are not supported by the depth side of the pressure plate 20*a* but downwardly suspended, guides the ends so that they may not caught by the front edge of the front bottom part 10*e*.

The supporting member 50*a* has a substantially "rectangular frame" shape in which a large opening surrounding the sliding range of the width direction regulating plates 101*a*, 101*b* of the sheet width regulation mechanism 100 is formed. Accordingly, the supporting member 50*a* has the shape that does not interfere with the width direction regulating plates 101*a*, 101*b* when the plates slide to accommodate sheets of paper of different sizes.

As shown in FIG. 12, when the pressure plate 20*a* and the supporting member 50*a* are horizontal, the width direction regulating plates 101*a*, 101*b* nearly entirely protrude into the holding chamber 11. As shown in FIG. 14, when the pressure plate 20*a* and the supporting member 50*a* are inclined, the width direction regulating 101*a*, 101*b* plates partly protrude into the holding chamber 11.

The depth direction regulating plate 102 is slidable along a rail 103 in the depth direction, and the position of the depth direction regulating plate 102 can be adjusted to conform sheets of paper in different sizes.

The sheet feeder 2 of embodiment 2 having such a configuration can also exert the same effects as those of the sheet feeder 1 of embodiment 1. Further, the sheet feeder 2 can accommodate plural sheet sizes by the sheet width regulation mechanism 100 and the depth direction regulating plate 102.

Furthermore, in the sheet feeder 2, the pressure plate 20*a* has the T-shape, not the substantially "H"-shape that is common in a conventional sheet feeder provided with a sheet width regulation mechanism. Accordingly, the problem that, when sheets of paper are inserted along an inclined pressure plate having a substantially "H"-shape, both ends at the depth side are apt to be caught by the lower lateral part of the substantially "H"-shape can be solved.

Moreover, in the sheet feeder 2, after sheets of paper are loaded in the sheet feed cassette 10 in the half-open state as shown in FIG. 14, the width adjustment with the sheet width regulation mechanism 100 can be performed by pushing down the pressure plate 20*a* and positioning the pressure plate 20*a* with the pressure plate positioning mechanism 80 in the horizontal state.

Embodiment 3

Figure 15:
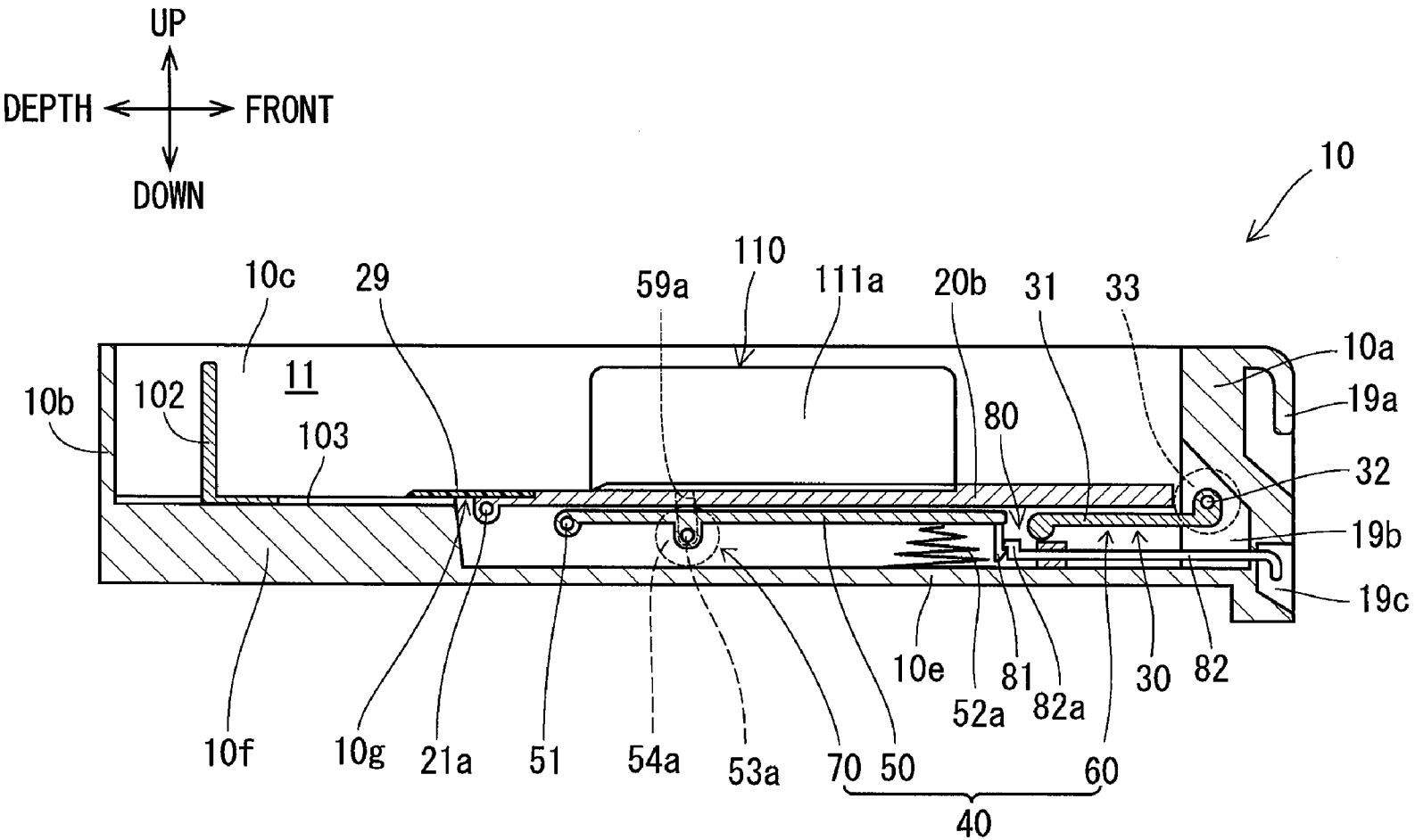
Figure 16:
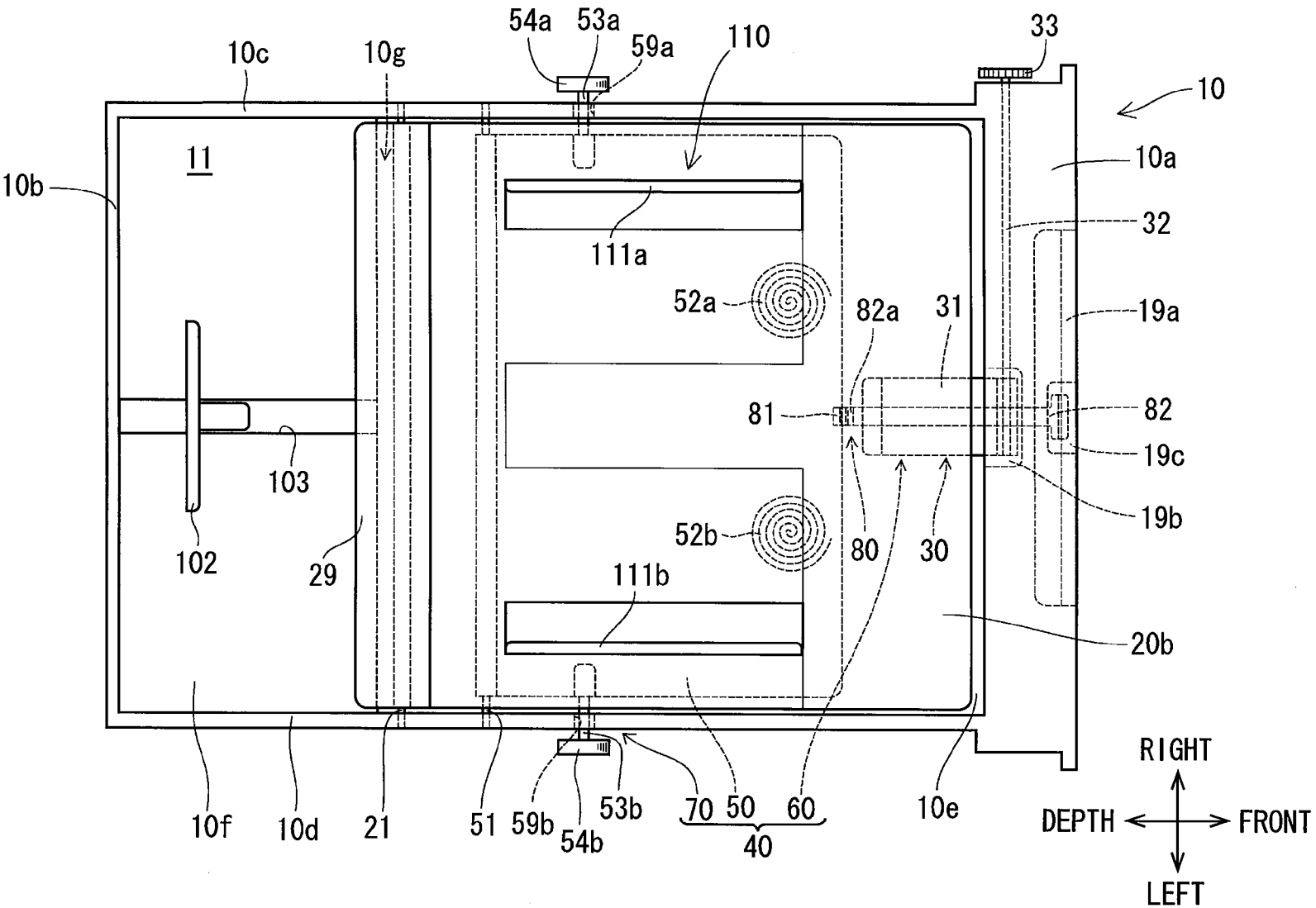
Figure 17:
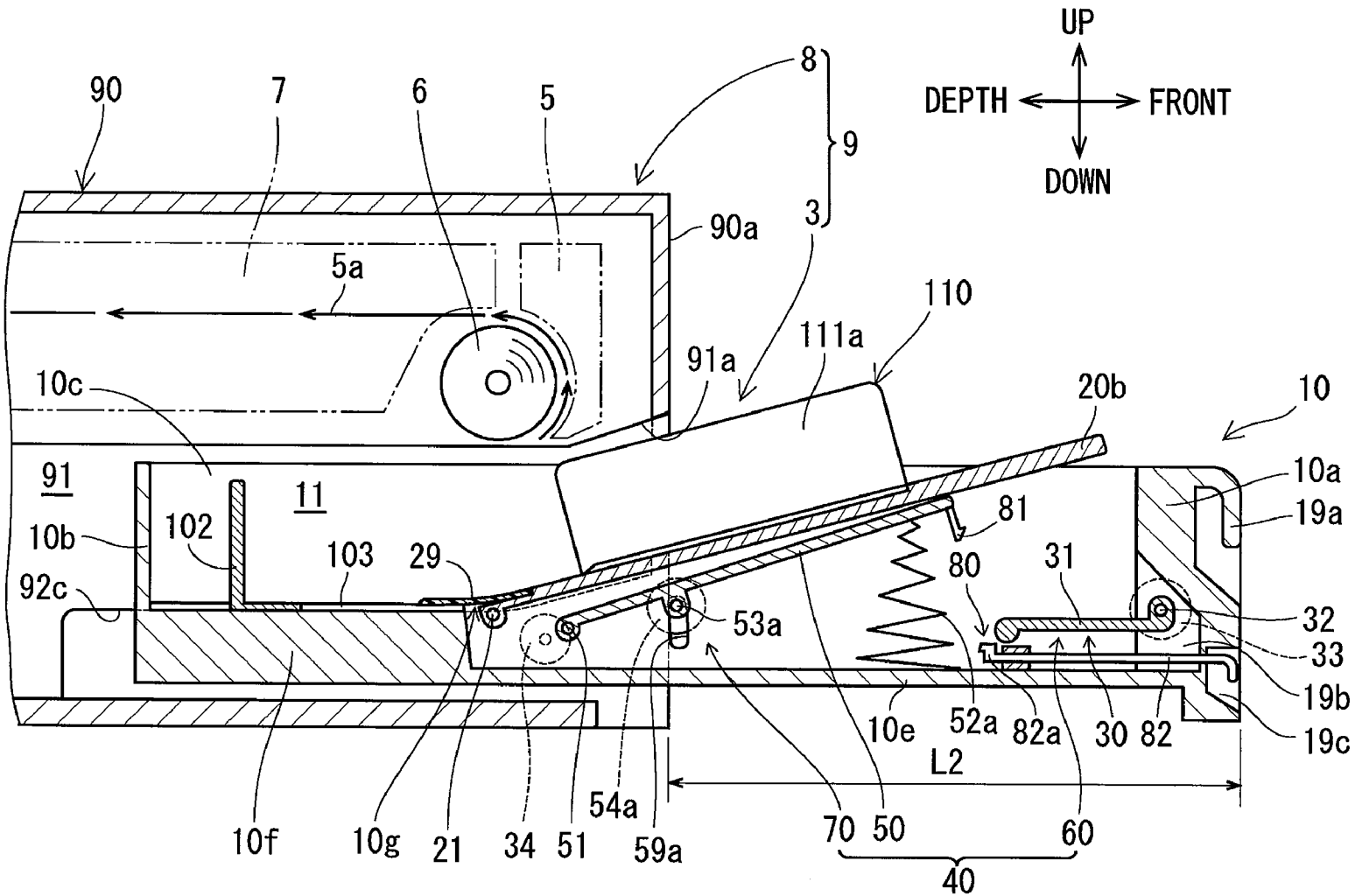

As shown in FIGS. 15 to 17, a sheet feeder 3 of embodiment 3 includes a sheet width regulation mechanism 110 provided on the upper surface of a pressure plate 20*b* having substantially the same shape as that of the pressure plate 20 of the sheet feeder 1 of embodiment 1, and a depth direction regulating plate 102 provided on the upper surface of the depth bottom part 10*f*. The other configuration is the same as that of the sheet feeder 1 of embodiment 1, and the description thereof will omitted.

The sheet width regulation mechanism 110 has a pair of width direction regulating plates 111*a*, 111*b*. The width direction regulating plates 111*a*, 111*b* are disposed to face each other at both sides on the upper surface of the pressure plate 20*b* in the width direction, and slidable in the width direction by a general sliding mechanism or the like (not shown) provided at the lower surface side of the pressure plate 20*b*.

The configuration of the depth direction regulating plate 102 is the same as that of the sheet feeder 2 of embodiment 2.

The sheet feeder 3 of embodiment 3 having such a configuration can also exert the same effects as those of the sheet feeders 1, 2 of embodiments 1, 2. Further, the sheet feeder 3 can accommodate plural sheet sizes by the sheet width regulation mechanism 110 and the depth direction regulating plate 102 as is the case of the sheet feeder 2 of embodiment 2.

Furthermore, the sheet feeder 3 is different from the sheet feeder 2 of embodiment 2 in that the sheet width regulation mechanism 110 is provided not on the bottom surface of the holding chamber 11, but on the upper surface of the pressure plate 20*b*. Accordingly, in the sheet feeder 3, as shown in FIG. 17, sheets of paper in different sizes can be loaded while the pressure plate 20*b* remains inclined by adjusting the sheet width regulation mechanism 110. In addition, in the sheet feeder 3, it is no longer necessary for the pressure plate 20*b* to have a shape that does not interfere with the sheet width regulation mechanism 110, and the pressure plate 20*b* may have a simple rectangular shape. Accordingly, the pressure plate 20*b* of the sheet feeder 3 can more reliably support from smaller sheets of paper to larger sheets of paper even in the inclined state compared to the pressure plate 20*a* having the T-shape in the sheet feeder 2 of embodiment 2.

By the way, in a sheet feeder disclosed in FIGS. 12 and 13 of JP-A-2003-212363, a sheet feed cassette having a box shape itself is drawn by the length less than the length of sheets of paper in the depth direction and inclined, the front wall of the sheet feed cassette is downwardly pivoted, and sheets of paper are loaded from the front surface side of the sheet feed cassette. The sheet feeder has a different configuration from the configuration of the sheet feeder of the invention in which not the sheet feed cassette itself but the pressure plate is inclined. Further, the sheet feeder is more complex in configuration and more difficult in downsizing and reduction of manufacturing cost compared to the sheet feeder of the invention.

The invention has been described according to embodiments 1 to 3 as above, however, as will be understood, the invention is not limited to the embodiments 1 to 3 and appropriate changes may be made without departing from the scope of the invention.

For example, as the links, general combinations of gears, levers, cams, guide rails, and other mechanical elements can be employed. Further, the links may be integrally formed or separately formed.

As the pressure plate positioning mechanism, for example, a mechanism having a movable locking member that directly locks the pressure plate along the bottom surface of the holding chamber may be employed. Further, as the pressure plate positioning mechanism, a mechanism having a movable locking member that locks the supporting member along the bottom surface of the holding chamber for indirectly positioning the pressure plate may be employed. In the case where the pressure plate positioning mechanism directly locks the pressure plate for positioning, it is preferable that the pressure plate positioning mechanism has a function of automatically unlocking the positioning of the pressure plate so as not to hinder the operation of the pressure mechanism when the sheet feed cassette is pushed into the cassette housing part. In this regard, in the case where the pressure plate positioning mechanism locks the supporting member to indirectly position the pressure plate, such a function is not required because the operation of the pressure mechanism is not hindered.

As the sheet member, a resin film or sheet, an elastically deformable metal thin plate, or other general members may be employed.

The invention is applicable to an electrophotographic printer or the like.

The invention claimed is:

1. A sheet feeder comprising:

a housing having a cassette housing part, the cassette housing part recessed horizontally from a front surface of the housing toward a depth direction, and having a pick-up roller that is driven rotationally about a horizontal axis perpendicular to the depth direction provided in an upper part at the front surface side within an opening of the housing;

a sheet feed cassette that has a holding chamber having an open top for storing stacked sheets, the sheet feed cassette configured to be housed within the cassette housing part and drawn from the cassette housing part;

a pressure plate provided pivotably about a pivot in parallel with the horizontal axis so as to be inclined downwardly toward the depth direction of the sheet feed cassette;

a pressure mechanism that presses the sheets against the pick-up roller by increasing an angle of inclination of the pressure plate when the sheet feed cassette is pushed into the cassette housing part; and a pressure plate regulation mechanism that inclines the pressure plate downwardly toward the depth direction while separating the sheets on the pressure plate or the pressure plate from the pick-up roller when the sheet feed cassette is drawn from the cassette housing, wherein the pressure plate regulation mechanism has a drive gear provided at the cassette housing part side and a driven gear provided at the sheet feed cassette side, the drive gear meshing with the driven gear when the sheet feed cassette is housed in the cassette housing part, wherein the pressure plate regulation mechanism has at least one spring provided at the sheet feed cassette side and configured to push the pressure plate in an upward direction, wherein when the sheet feed cassette is housed in the cassette housing part, the driven gear is driven by the drive gear and pushes up the pressure plate without the spring pushing the pressure plate, and wherein when the sheet feed cassette is drawn from the cassette housing part, the spring pushes up the pressure plate while the driven gear is separated from the drive gear and without the driven gear pushing up the pressure plate.

2. The sheet feeder according to claim 1, wherein the pressure plate regulation mechanism includes:

a supporting member that is configured to receive a pushing force of the spring and to support the pressure plate from below; and links provided between the housing and the sheet feed cassette for guiding the supporting member while the sheet feed cassette is drawn from the cassette housing part.

3. The sheet feeder according to claim 2, wherein the supporting member is a plate-like member provided between the pressure plate and a bottom surface of the holding chamber.

4. The sheet feeder according to claim 2, wherein the links include:

a first link that reduces the angle of inclination of the pressure plate to separate the sheets on the pressure plate or the pressure plate from the pick-up roller when the sheet feed cassette is drawn from the cassette housing part; and a second link that downwardly inclines the pressure plate toward the depth direction again when the sheet feed cassette is drawn from the cassette housing part.

5. The sheet feeder according to claim 4, wherein the supporting member is a plate-like member provided between the pressure plate and a bottom surface of the holding chamber, and the pressure mechanism and the first link include:

a rotating shaft buried rotatably about the horizontal axis within a front wall part of the sheet feed cassette and having a first end projecting out of the sheet feed cassette;

the driven gear fixed to the first end of the rotating shaft;

the drive gear provided to project from within the cassette housing part, meshing with the driven gear when the sheet feed cassette is housed in the cassette housing part, and controlled by a pressure mechanism control unit; and a lever provided at the sheet feed cassette side and extending in the depth direction to position a depth edge of the lever below the front side of the pressure plate, the lever having a second end of the rotating shaft fixed thereto.

6. The sheet feeder according to claim 4, wherein the supporting member is a plate-like member provided between the pressure plate and a bottom surface of the holding chamber, and the second link includes:

a pair of guide roller shafts provided at edges of the supporting member in the width direction, and projecting from the sheet feed cassette to the outside;

guide rollers rotatably supported on ends of the respective guide roller shafts outside of the sheet feed cassette;

at last one coil spring provided between a front lower surface of the supporting member and a front bottom part of the sheet feed cassette and energizing the front side of the supporting member to push the front side in an upward direction; and guide rails formed in the cassette housing part, and having depth parts of downward horizontal surfaces and front parts of downwardly inclined surfaces that continue with the horizontal surfaces and rise frontward.

7. The sheet feeder according to claim 2, wherein the supporting member has a substantially rectangular frame shape provided between the pressure plate and the bottom surface of the holding chamber.

8. The sheet feeder according to claim 1, wherein a sheet width regulation mechanism that regulates a position of the sheet in a width direction according to a size of the sheet is provided on the bottom surface of the holding chamber, and the pressure plate has a T-shape with a front side corresponding to an upper lateral part of the T-shape and a depth side corresponding to a lower longitudinal part of the T-shape, and formed in the shape that does not interfere with the sheet width regulation mechanism.

9. The sheet feeder according to claim 1, wherein a sheet width regulation mechanism that regulates a position of the sheet in a width direction according to a size of the sheet is provided on the upper surface of the pressure plate.

10. The sheet feeder according to claim 1, wherein a pressure positioning mechanism that positions the pressure plate along the bottom surface of the holding chamber is provided between the sheet feed cassette and the pressure plate.

11. The sheet feeder according to claim 10, wherein the pressure positioning mechanism has a latch member formed on the supporting member, and a locking member provided on the sheet feed cassette slidably in the depth direction and having a locking lug formed on the depth end thereof.

12. The sheet feeder according to claim 1, wherein a sheet member is provided between the upper surface at the pivot in the pressure plate and the bottom surface of the holding chamber for covering a gap produced between the surfaces.

13. An image forming apparatus comprising a sheet feeder, the sheet feeder including:

a housing having a cassette housing part, the cassette housing part recessed horizontally from a front surface of the housing toward the depth direction, and having a pick-up roller that is driven rotationally about a horizontal axis perpendicular to the depth direction provided in an upper part at the front surface side within an opening of the housing;

a sheet feed cassette that has a holding chamber having an open top for storing stacked sheets, the sheet feed cassette configured to be housed within the cassette housing part and drawn from the cassette housing part;

a pressure plate provided pivotably about a pivot in parallel with the horizontal axis so as to be inclined downwardly toward the depth direction of the sheet feed cassette;

a pressure mechanism that presses the sheets against the pick-up roller by increasing an angle of inclination of the pressure plate when the sheet feed cassette is pushed into the cassette housing part; and a pressure plate regulation mechanism that inclines the pressure plate downwardly toward the depth direction while separating the sheets on the pressure plate or the pressure plate from the pick-up roller when the sheet feed cassette is drawn from the cassette housing part by a length less than a length of the sheets in the depth direction, wherein the pressure plate regulation mechanism has a drive gear provided at the cassette housing part side and a driven gear provided at the sheet feed cassette side, the drive gear meshing with the driven gear when the sheet feed cassette is housed in the cassette housing part, wherein the pressure plate regulation mechanism has at least one spring provided at the sheet feed cassette side and configure to push the pressure plate in an upward direction, wherein when the sheet feed cassette is housed in the cassette housing part, the driven gear is driven by the drive gear and pushes up the pressure plate without the spring pushing up the pressure plate, and wherein when the sheet feed cassette is drawn from the cassette housing part, the spring pushes up the pressure plate while the driven gear is separated from the drive gear and without the driven gear rushing up the pressure plate.

14. The image forming apparatus according to claim 13, being an electrophotographic printer, wherein the housing is commonly used with a printer main body.

15. The image forming apparatus according to claim 14, wherein the printer main body includes an image forming unit above the housing.

16. The image forming apparatus according to claim 15, wherein the cassette housing part is located below the image forming unit.

17. A sheet feeder comprising:

a housing having a cassette housing part, the cassette housing part recessed horizontally from a front surface of the housing toward a depth direction, and having a pick-up roller that is driven rotationally about a horizontal axis perpendicular to the depth direction provided in an upper part at the front surface side within an opening of the housing;

a sheet feed cassette that has a holding chamber having an open top for storing stacked sheets, the sheet feed cassette configured to be housed within the cassette housing part and drawn from the cassette housing part;

a pressure plate provided pivotably about a pivot in parallel with the horizontal axis so as to be inclined downwardly toward the depth direction of the sheet feed cassette;

a pressure mechanism that presses the sheets against the pick-up roller by increasing an angle of inclination of the pressure plate when the sheet feed cassette is pushed into the cassette housing part; and a pressure plate regulation mechanism that inclines the pressure plate downwardly toward the depth direction while separating the sheets on the pressure plate or the pressure plate from the pick-up roller when the sheet feed cassette is drawn from the cassette housing part by a length less than a length of the sheets in the depth direction, wherein the pressure plate regulation mechanism includes:

a supporting member that is configured to receive a pushing force of the spring and to support the pressure plate from below; and links provided between the housing and the sheet feed cassette for guiding the supporting member while the sheet feed cassette is drawn from the cassette housing part;

wherein the links include:

a first link that reduces the angle of inclination of the pressure plate to separate the sheets on the pressure plate or the pressure plate from the pick-up roller when the sheet feed cassette is drawn from the cassette housing part; and a second link that downwardly inclines the pressure plate toward the depth direction again when the sheet feed cassette is drawn from the cassette housing part by the length less than a length of the sheets in the depth direction, wherein the supporting member is a plate-like member provided between the pressure plate and a bottom surface of the holding chamber, and the pressure mechanism and the first link include:

a rotating shaft buried rotatably about the horizontal axis within a front wall part of the sheet feed cassette and having a first end projecting out of the sheet feed cassette;

a driven gear fixed to the first end of the rotating shaft;

a drive gear provided to project from within the cassette housing part, meshing with the driven gear when the sheet feed cassette is housed in the cassette housing part, and controlled by a pressure mechanism control unit; and a lever provided at the sheet feed cassette side and extending in the depth direction to position a depth edge of the lever below the front side of the pressure plate, the lever having a second end of the rotating shaft fixed thereto.

* * * * *